US006442980B2

(12) United States Patent
Preston et al.

(10) Patent No.: US 6,442,980 B2
(45) Date of Patent: Sep. 3, 2002

(54) CARBON DIOXIDE DRY CLEANING SYSTEM

(75) Inventors: A. Duane Preston, New Prague; Jon R. Turner, Lakeville; Charles Svoboda, New Prague, all of MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 09/835,168

(22) Filed: Apr. 13, 2001

Related U.S. Application Data

(63) Continuation-in-part of application No. 09/313,426, filed on May 17, 1999, now Pat. No. 6,216,302, which is a continuation-in-part of application No. 08/979,060, filed on Nov. 26, 1997, now Pat. No. 5,904,737.

(51) Int. Cl.[7] ..... D06F 43/08; B08B 3/10

(52) U.S. Cl. ..... 68/18; 68/18 R; 68/18 F; 134/107

(58) Field of Search ..... 8/158, 142; 68/18 R, 68/18 C, 18 F; 134/10, 12, 107, 108

(56) References Cited

U.S. PATENT DOCUMENTS 4,012,194 A * 3/1977 Chao et al.
4,077,878 A * 3/1978 Jackson
4,936,922 A * 6/1990 Cherry
5,232,476 A * 8/1993 Grant
5,267,455 A * 12/1993 Dewees et al.
5,279,615 A * 1/1994 Mitchell et al.
5,344,493 A * 9/1994 Jackson
5,412,958 A * 5/1995 Iliff et al.
5,467,492 A * 11/1995 Chao et al.
5,469,876 A * 11/1995 Gray et al.
5,486,212 A * 1/1996 Mitchell et al.
5,538,025 A * 7/1996 Gray et al.
5,611,491 A * 3/1997 Bowers
5,642,987 A * 7/1997 Taricco
5,651,276 A * 7/1997 Purer et al.
5,669,251 A * 9/1997 Townsend et al.
5,822,818 A * 10/1998 Chao et al.
5,970,554 A * 10/1999 Shore et al.

FOREIGN PATENT DOCUMENTS

EP 0 828 020 A2 * 8/1997
EP 0 919 659 A2 * 6/1999
WO WO 94/01227 * 1/1994
WO WO 96/15304 * 5/1996
WO WO 97/33031 * 9/1997
WO WO 99/13148 * 3/1999

* cited by examiner

*Primary Examiner*—Philip Coe
(74) *Attorney, Agent, or Firm*—Piper-Rudnick; R. Blake Johnston

(57) ABSTRACT

A carbon dioxide dry cleaning system features a pair of liquid carbon dioxide storage tanks in communication with a compressor. A sealed cleaning chamber contains the objects to be cleaned. By selectively pressurizing the storage tanks with the compressor, liquid carbon dioxide is made to flow to the cleaning chamber through cleaning nozzles so as to provide agitation of the objects being dry cleaned. Liquid carbon dioxide displaced from the cleaning chamber returns to the storage tanks. In an alternative embodiment, a single storage tank is pressurized via a compressor with gas from the cleaning chamber so that liquid solvent from the storage tank travels to the cleaning chamber through nozzles. The objects in the cleaning chamber are agitated by a rotating basket. After a prewash cycle, liquid solvent from the cleaning chamber is directed to a still. The liquid solvent in the still is boiled through a connection with the head space of the cleaning chamber. The still may be positioned within the storage tank and partially surrounded with a shroud for efficient heating of the still with gas from the cleaning chamber. During agitation, liquid solvent from the cleaning chamber may be heated and filtered.

21 Claims, 19 Drawing Sheets

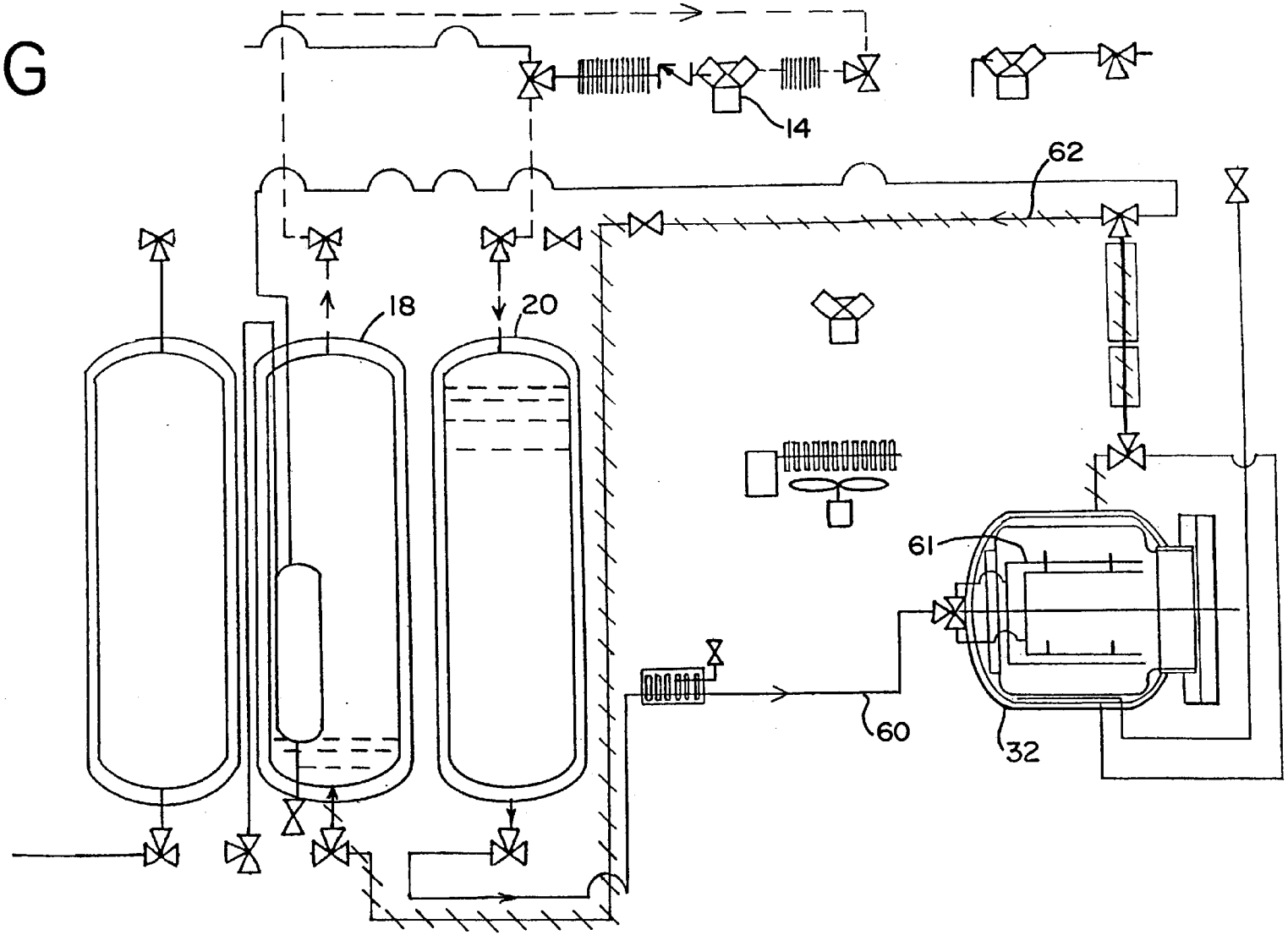
FIG.IG

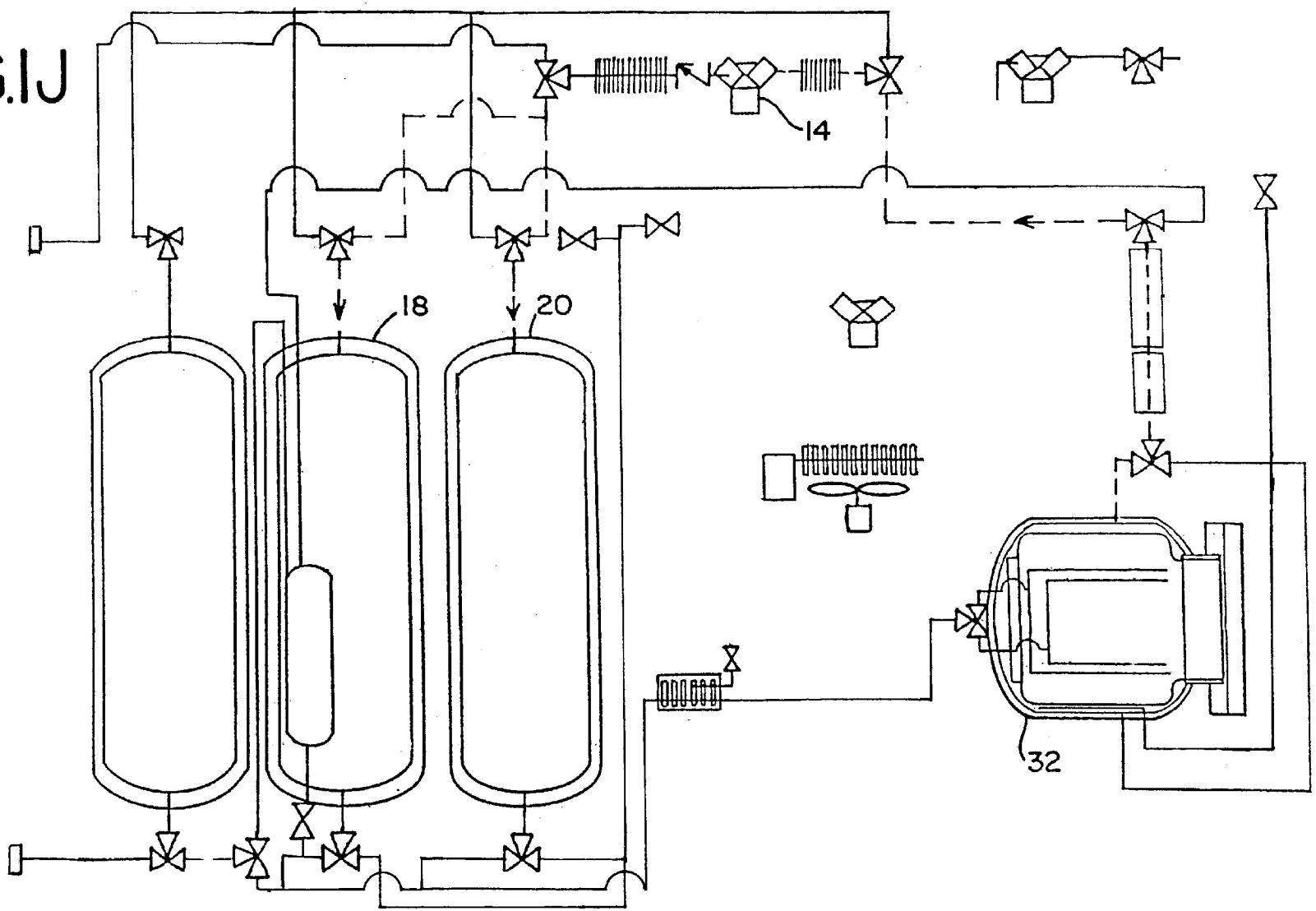
FIG.IJ

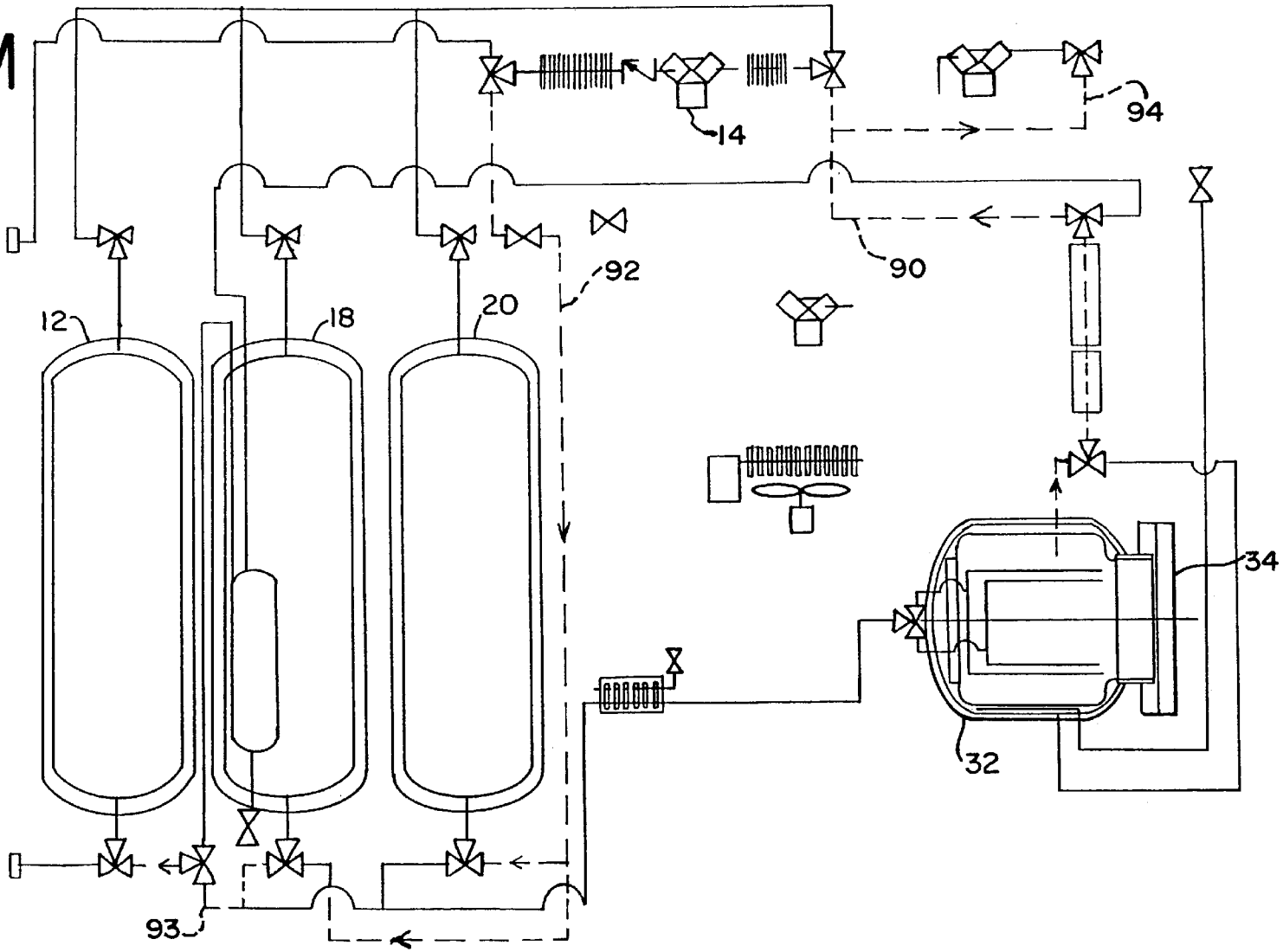
FIG.IM

CARBON DIOXIDE DRY CLEANING SYSTEM

CROSS REFERENCE TO RELATED APPLICATIONS

This application is a continuation-in-part of U.S. application Ser. No. 09/313,426, filed May 17, 1999, now U.S. Pat. No. 6,216,302, which is a continuation-in-part of U.S. application Ser. No. 08/979,060, filed Nov. 26, 1997, now U.S. Pat. No. 5,904,737.

BACKGROUND

The present invention generally relates to carbon dioxide dry cleaning systems and, more particularly, to improved carbon dioxide dry cleaning systems that purify and reclaim carbon dioxide without the use of heaters and that do not use pumps to move liquid carbon dioxide.

The dry cleaning industry makes up one of the largest groups of chemical users that come into direct contact with the general public. Currently, the dry cleaning industry primarily uses perchloroethylene ("perc") and petroleum-based solvents. These solvents present health and safety risks and are detrimental to the environment. More specifically, perc is a suspected carcinogen while petroleum-based solvents are flammable and produce smog. For these reasons, the dry cleaning industry is engaged in an ongoing search for alternative, safe and environmentally "green" cleaning technologies, substitute solvents and methods to control exposure to dry cleaning chemicals.

Liquid carbon dioxide has been identified as a solvent that is an inexpensive and an unlimited natural resource. Furthermore, liquid carbon dioxide is non-toxic, non-flammable and does not produce smog. Liquid carbon dioxide does not damage fabrics or dissolve common dyes and exhibits solvating properties typical of more traditional solvents. Its properties make it a good dry cleaning medium for fabrics and garments. As a result, several dry cleaning systems utilizing carbon dioxide as a solvent have been developed.

U.S. Pat. No. 4,012,194 to Maffei discloses a simple dry cleaning process wherein garments are placed in a cylinder and liquid carbon dioxide is gravity fed thereto from a refrigerated storage tank. The liquid carbon dioxide passes through the garments, removing soil, and is transferred to an evaporator. The evaporator vaporizes the carbon dioxide so that the soil is left behind. The vaporized carbon dioxide is pumped to a condenser and the liquid carbon dioxide produced thereby is returned to the refrigerated storage tank.

The system of Maffei, however, does not disclose a means for agitating the garments. Furthermore, because the system of Maffei does not disclose a means for pressurizing the chamber, the carbon dioxide must be very cold to remain in a liquid state. Both of these limitations inhibit the cleaning performance of the Maffei system.

U.S. Pat. No. 5,267,455 to Dewees et al. discloses a system wherein liquid carbon dioxide is pumped to a pressurized cleaning chamber from a pressurized storage vessel. The cleaning chamber features a basket containing the soiled garments. The interior of the basket includes projecting vanes so that a tumbling motion is induced upon the garments when the basket is rotated by an electric motor. This causes the garments to drop and splash into the solvent. This method of agitation, known as the "drop and splash" technique, is used by the majority of traditional dry cleaning systems. After agitation, a compressed gas is pumped into the chamber to replace the liquid carbon dioxide. The displaced "dirty" liquid carbon dioxide is pumped to a vaporizer which is equipped with an internal heat exchanger. This allows "clean" gaseous carbon dioxide to be recovered and routed back to the storage vessel.

While the system of Dewees et al. overcomes the shortcomings of Maffei, namely, the lack of an agitation means and a pressurized cleaning chamber, it relies upon a pump to move its liquid carbon dioxide and utilizes a heat exchanger in its vaporizer. Both of these components add complexity, cost and maintenance requirements to the system.

Many patents have disclosed improved agitation arrangements for carbon dioxide dry cleaning systems. For example, U.S. Pat. No. 5,467,492 to Chao et al. discloses a fixed perforated basket combined with a variety of agitation techniques. These include "gas bubble/boiling agitation" where the liquid carbon dioxide in the basket is boiled, "liquid agitation" where nozzles spraying carbon dioxide tumble the liquid and garments, "sonic agitation" where sonic nozzles create agitating waves and "stirring agitation" where an impeller creates the fluid agitation. The remaining portion of the system of Chao, however, does not provide for a significant improvement over Dewees et al. in that a pump is still relied upon to move the liquid carbon dioxide from the system storage container to the cleaning chamber.

U.S. Pat. No. 5,651,276 to Purer et al. discloses an agitation technique which removes particulate soils from fabrics by gas jets. This gas agitation process is performed separately from the solvent-immersion process. Purer et al. further disclose that carbon dioxide may be employed both as the gas and the solvent. U.S. Pat. No. 5,669,251 to Townsend et al. discloses a rotating basket for a carbon dioxide dry cleaning system powered by a hydraulic flow emitted by a number of nozzles. This eliminates the need for rotating seals and drive shafts. While these two patents address agitation techniques, they do not address the remaining portion of the dry cleaning system.

Finally, the Hughes DRYWASH carbon dioxide dry cleaning machine, manufactured by Hughes Aircraft Company of Los Angeles, Calif., utilizes a pump to fill a pressurized cleaning chamber with liquid carbon dioxide. The cleaning chamber contains a fixed basket featuring four nozzles. As the basket is being filled with carbon dioxide, all four nozzles are open. Once the basket is filled, however, two of the nozzles are closed. The remaining two open nozzles are positioned so that they create an agitating vortex within the basket as liquid carbon dioxide flows through them. Soil-laden liquid carbon dioxide exits the basket and chamber and is routed to a lint trap and filter train. Furthermore, the system features a still that contains an electric heater so that soluble impurities may be removed.

While the Hughes DRYWASH system is effective, it also suffers the cost, maintenance and reliability disadvantages associated with a liquid pump and an electrically heated still.

Accordingly, it is an object of the present invention to provide an improved carbon dioxide dry cleaning system that utilizes both the solvent properties of carbon dioxide and agitation to remove insoluble particles.

It is a further object of the present invention to provide an improved carbon dioxide dry cleaning system that moves liquid solvent without the use of a pump.

It is a further object of the present invention to provide an improved carbon dioxide dry cleaning system that is economical to operate.

It is still a further object of the present invention to provide an improved carbon dioxide dry cleaning system that filters and distills its solvent.

These and other objects of the invention will be apparent from the remaining portion of the Specification.

SUMMARY

The present invention is directed to a liquid carbon dioxide dry cleaning system that moves liquid carbon dioxide without the use of a pump. Because liquid carbon dioxide, when used as a solvent, is at a high pressure and in a saturated state, suitable pumps are expensive and not nearly as reliable as devices used for ambient temperature liquids.

A first embodiment of the system features a pair of storage tanks containing liquid carbon dioxide. A compressor initially is connected in circuit between the head space of one of the storage tanks and a sealed cleaning chamber containing the objects being dry cleaned. The liquid side of the storage tank is connected to the cleaning chamber. As a result, the storage tank is pressurized so that liquid carbon dioxide flows from it to the cleaning chamber.

Next, the compressor is placed in circuit between the storage tanks so that gas may be withdrawn from the now empty storage tank and used to pressurize the other storage tank, also filled with liquid carbon dioxide. The liquid side of the empty storage tank remains connected to the cleaning chamber while the liquid side of the full storage tank is connected to cleaning nozzles within the cleaning chamber. As a result, when the full storage tank is pressurized, liquid carbon dioxide flows from it, through the nozzles and into the cleaning chamber so as to agitate the objects being cleaned. The displaced liquid carbon dioxide from the cleaning chamber flows back to the empty storage tank.

The agitation pressure may be controlled so that delicate objects may be cleaned without damage. Solvent additives may also be injected into the liquid carbon dioxide.

A still, submerged in the liquid carbon dioxide within one of the storage tanks, receives soiled liquid carbon dioxide from the cleaning chamber. Gas is withdrawn from the still by the compressor and is used to pressurize the storage tank containing the still. Alternatively, the still may be connected to the liquid side of a low pressure transfer tank. As a result, gas from the still is returned to the transfer tank where it is recondensed by the cold liquid carbon dioxide contained therein. In either case, the pressure difference created between the still and storage tank causes the soiled liquid carbon dioxide to boil due to the heat supplied by the liquid carbon dioxide surrounding the still. This removes the carbon dioxide in gaseous form leaving the contaminants in the still. Heat is also removed from the liquid carbon dioxide surrounding the still without reducing the heat in the system and without mechanical refrigeration.

An alternative embodiment of the present invention includes a cleaning chamber containing objects to be cleaned and a storage tank containing a supply of liquid solvent such as liquid carbon dioxide. A compressor pressurizes the storage tank with gas from the cleaning chamber so that liquid solvent is delivered to the cleaning chamber through nozzles. The cleaning chamber includes a basket rotatably mounted therein for agitating the objects during one or more prewash and wash cycles. A transfer tank contains an additional supply of liquid solvent and selectively communicates with the cleaning chamber so that additional solvent may be added to the system.

The system features a still containing contaminated liquid solvent received from the cleaning chamber after a previous prewash cycle. The cleaning chamber is pressurized with gas from the still so that the contaminated liquid solvent in the still is vaporized and transferred to said cleaning chamber. The compressor may be used to accelerate this process. The still may be equipped with a steam supply line or other heating means for improved boiling. The still may optionally be placed within the storage tank and partially surrounded with a shroud to direct warm gas from the compressor as it withdraws gas from the cleaning chamber to efficiently heat the still promoting the boiling of the contaminated liquid within.

The system includes a filter for filtering liquid solvent from the wash chamber after each wash cycle. A dispenser injects additives such as detergent and softeners into the liquid solvent exiting the filter. One or more prewash cycles may be performed after which liquid solvent from the cleaning chamber bypasses the carbon portion of the filter and travels directly to the still.

During the wash cycles liquid solvent may be withdrawn from the cleaning chamber, filtered and returned to the cleaning chamber so that constant filtration is provided. Solvent gas may be withdrawn from the storage tank so that the liquid therein boils. The resulting vapor may be raised in pressure and temperature by the compressor and introduced into the liquid solvent in the cleaning chamber so that the liquid solvent is warmed and its cleaning properties are enhanced.

Pressure relief valves are positioned between the cleaning chamber and the head space of the storage tank and the filter and the head space of the storage tank to relieve pressure in the cleaning chamber and filter in the event of an emergency system shutdown without venting gas to the atmosphere.

For a more complete understanding of the nature and scope of the invention, reference may now be had to the following detailed description of embodiments thereof taken in conjunction with the appended claims and accompanying drawings.

BRIEF DESCRIPTION OF THE DRAWINGS

FIGS. 1A–1M are schematic diagrams illustrating the operation of an embodiment of the carbon dioxide dry cleaning system of the present invention wherein three carbon dioxide tanks are used;

DESCRIPTION

Figure 1A:
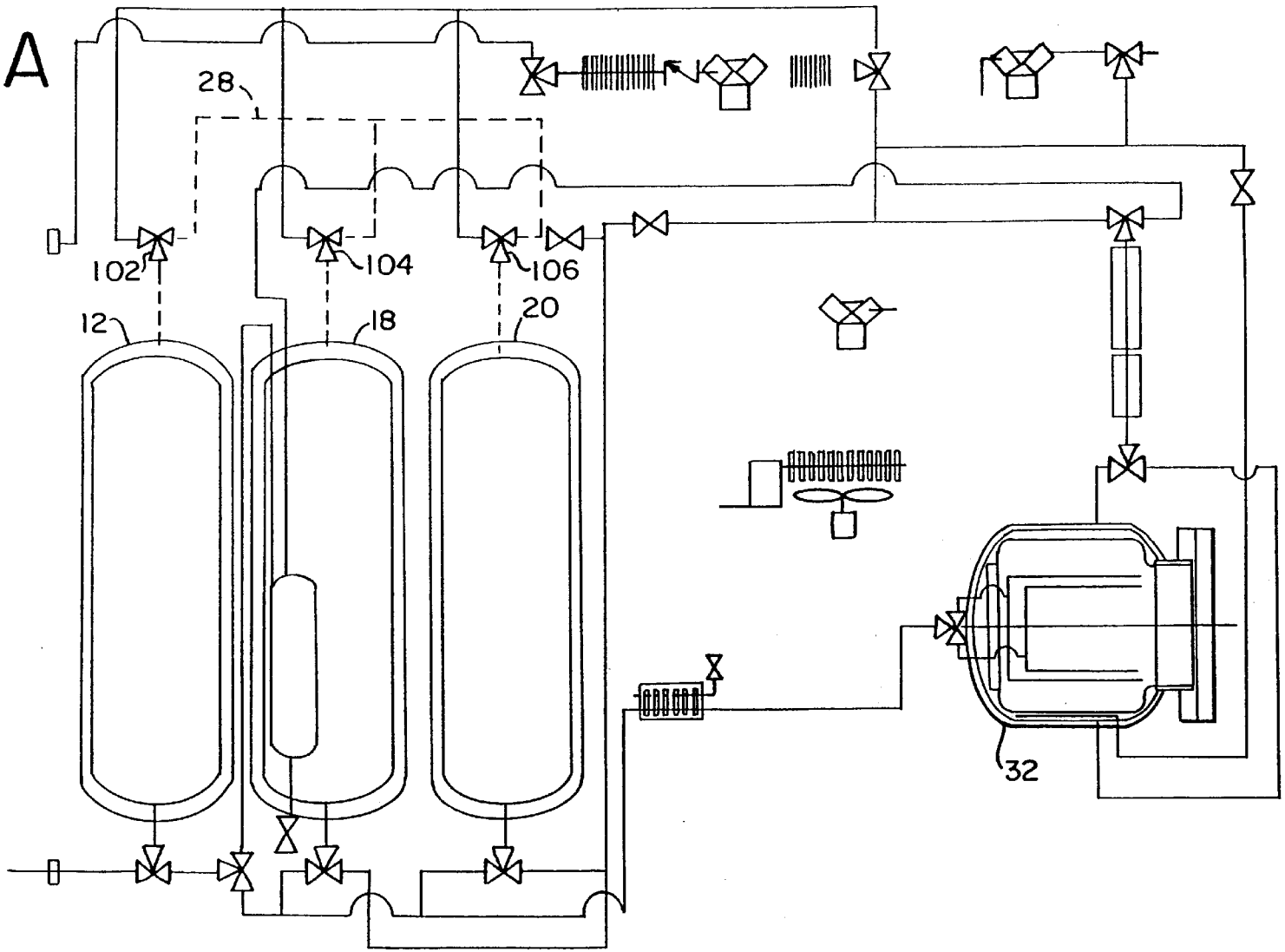

An embodiment of the carbon dioxide dry cleaning system of the present invention is shown in FIG. 1A. A cold transfer tank, indicated at 12, contains a supply of liquid carbon dioxide at a pressure between 200 and 250 psi and at a temperature of approximately −15° F. Preferably, the liquid carbon dioxide contains additives to promote better cleaning and deodorizing. Transfer tank 12 is sized to hold approximately two week's worth of liquid carbon dioxide. Transfer tank 12 may be refilled from a mobile delivery tanker in a conventional manner.

High pressure storage tanks 18 and 20 contain liquid carbon dioxide at a pressure of approximately 650 to 690 psi. The two storage tanks may be refilled from transfer tank 12 when they become depleted. This may be done between each garment load or one time in the morning. To perform refilling, the head space of transfer tank 12 is initially connected to the head spaces of storage tanks 18 and 20 so that their pressures are equalized. This is shown in FIG. 1A by line 28.

Figure 1B:
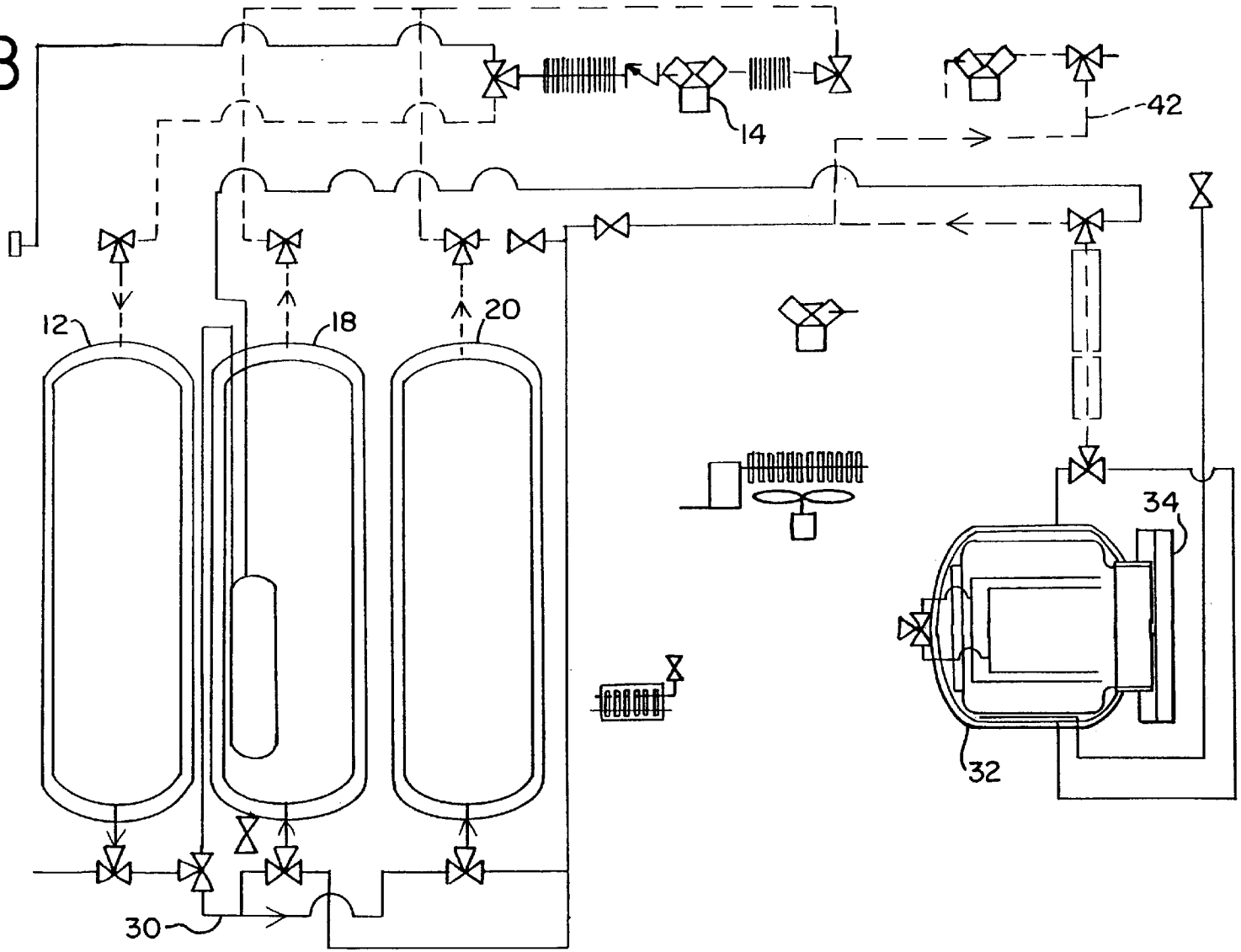

Then, as shown in FIG. 1B, the head spaces of storage tanks 18 and 20 are connected to the suction side of a compressor 14. The discharge side of compressor 14 is connected to the head space of transfer tank 12. As a result, the pressure in transfer tank 12 is increased while the pressure in storage tanks 18 and 20 is decreased. This causes liquid carbon dioxide to flow at a high pressure, as indicated by thick line 30, from the liquid side of transfer tank 12 to the liquid sides of storage tanks 18 and 20.

Once storage tanks 18 and 20 are properly filled with a supply of liquid carbon dioxide, the dry cleaning process may begin. While the system of the present invention is described and discussed below in terms of dry cleaning fabrics, it is to be understood that the system may be used alternatively to perform other cleaning tasks where liquid carbon dioxide is an appropriate solvent. For example, the system could be used to degrease mechanical parts.

Referring to FIG. 1B, soiled garments or the like are placed in cleaning chamber 32. The door 34 of the cleaning chamber 32 features a seal, such as a large rubber O-ring, so that the chamber may be pressurized when the door is closed. In addition, door 34 features an interlocking system so as to prevent the door from opening while chamber 32 is pressurized. Such interlocking systems are well known in the art. Once the garments are loaded, and cleaning chamber 32 sealed, the air therein is evacuated using compressor 14, as shown by line 42 in FIG. 1B. This is done to prevent condensation when the chamber is pressurized.

Figure 1C:
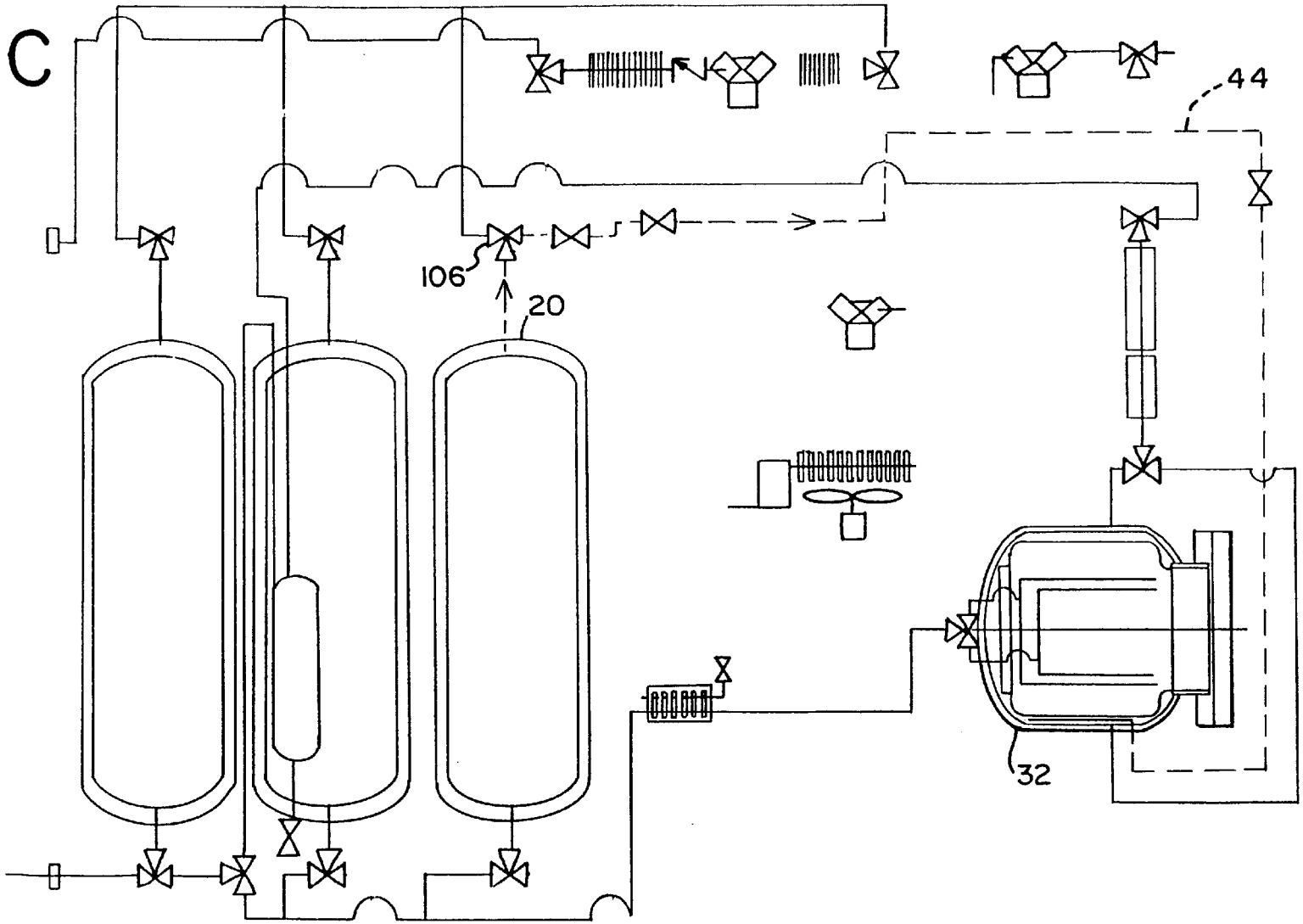

Next, as shown by line 44 in FIG. 1C, the head space of one of the storage tanks (tank 20 in FIG. 1C) is connected to the chamber so that the latter is pressurized with carbon dioxide gas to an intermediate pressure of about 70 psi. Once chamber 32 is pressurized to an intermediate pressure, it may be filled with high pressure liquid carbon dioxide without the formation of dry ice or the occurrence of extreme thermal shock.

Figure 1D:
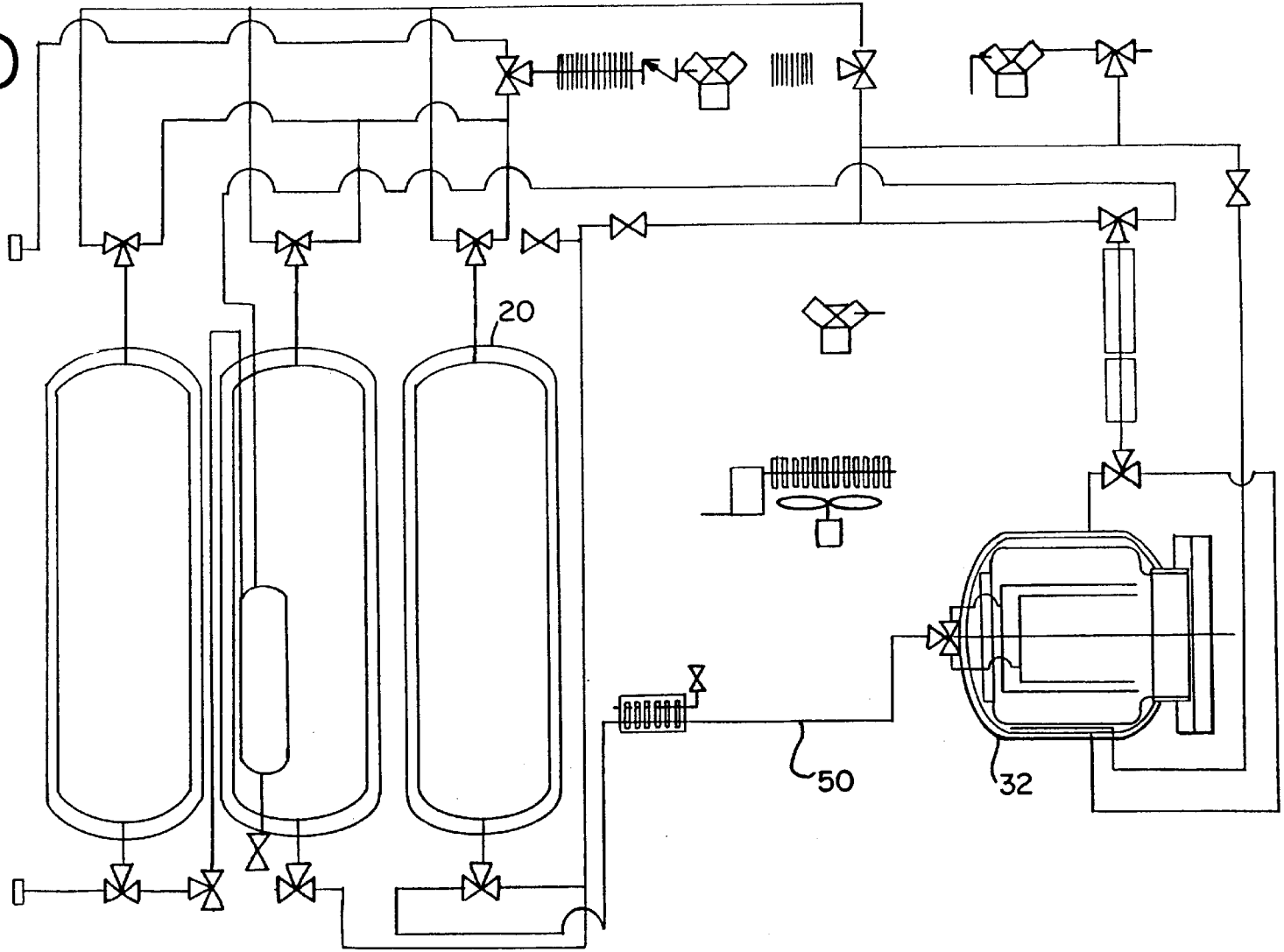
Figure 1E:
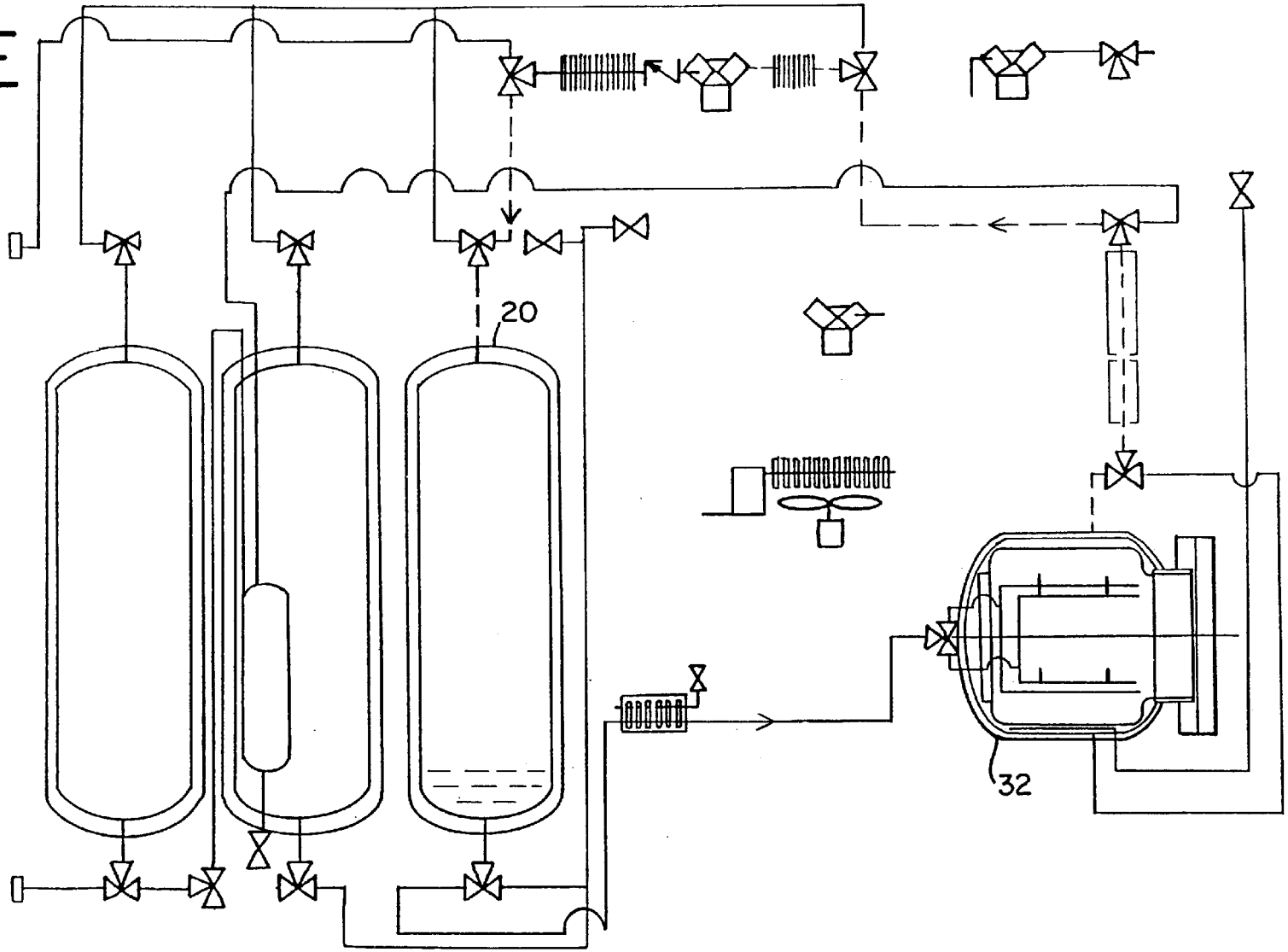

As shown in FIG. 1D, high pressure liquid carbon dioxide is then fed through line 50 via the pressure differential between storage tank 20 and cleaning chamber 32. This almost completely fills the chamber 32 without the use of a compressor or pump. Because chamber 32 and storage tank 20 (and storage tank 18) are approximately the same size, the carbon dioxide remaining in storage tank 20 may be used to finish filling chamber 32. This is accomplished, as shown in FIG. 1E, by using compressor 14 to remove carbon dioxide gas from chamber 32 and direct it back to storage tank 20. This forces the liquid carbon dioxide remaining in storage tank 20 into chamber 32 so as to completely fill it.

At this point, the liquid carbon dioxide within filled chamber 32 is at a pressure and temperature of about 650 psi and 54° F., respectively. It has been determined that liquid carbon dioxide is an effective solvent at such a temperature and that it will not harm most fabrics. The system is now ready to begin the agitation process. Agitation is necessary so that the system may remove non-soluble particles that are not removed merely by submersing the garments in the liquid carbon dioxide.

Figure 1F:
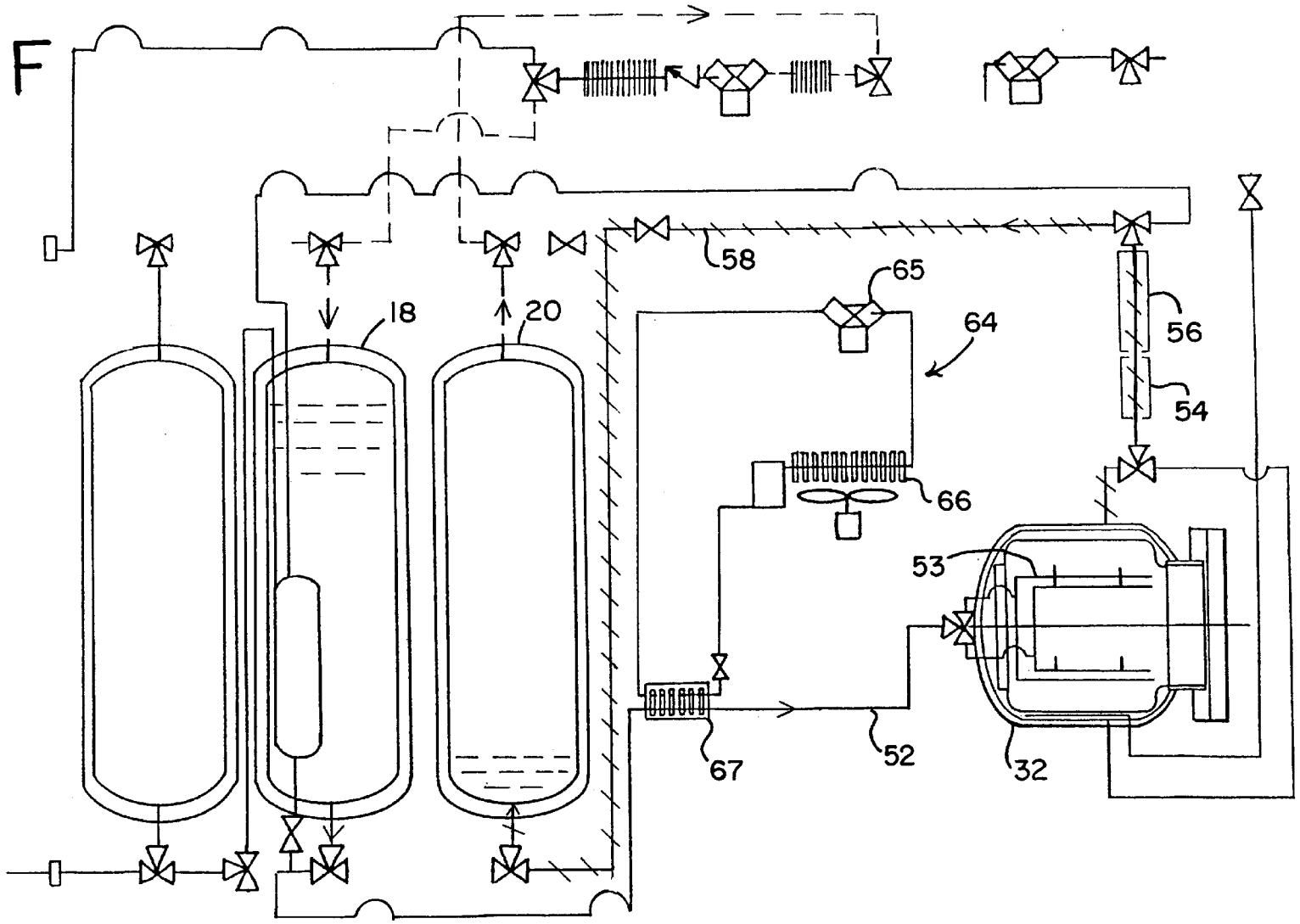
Figure 11H:
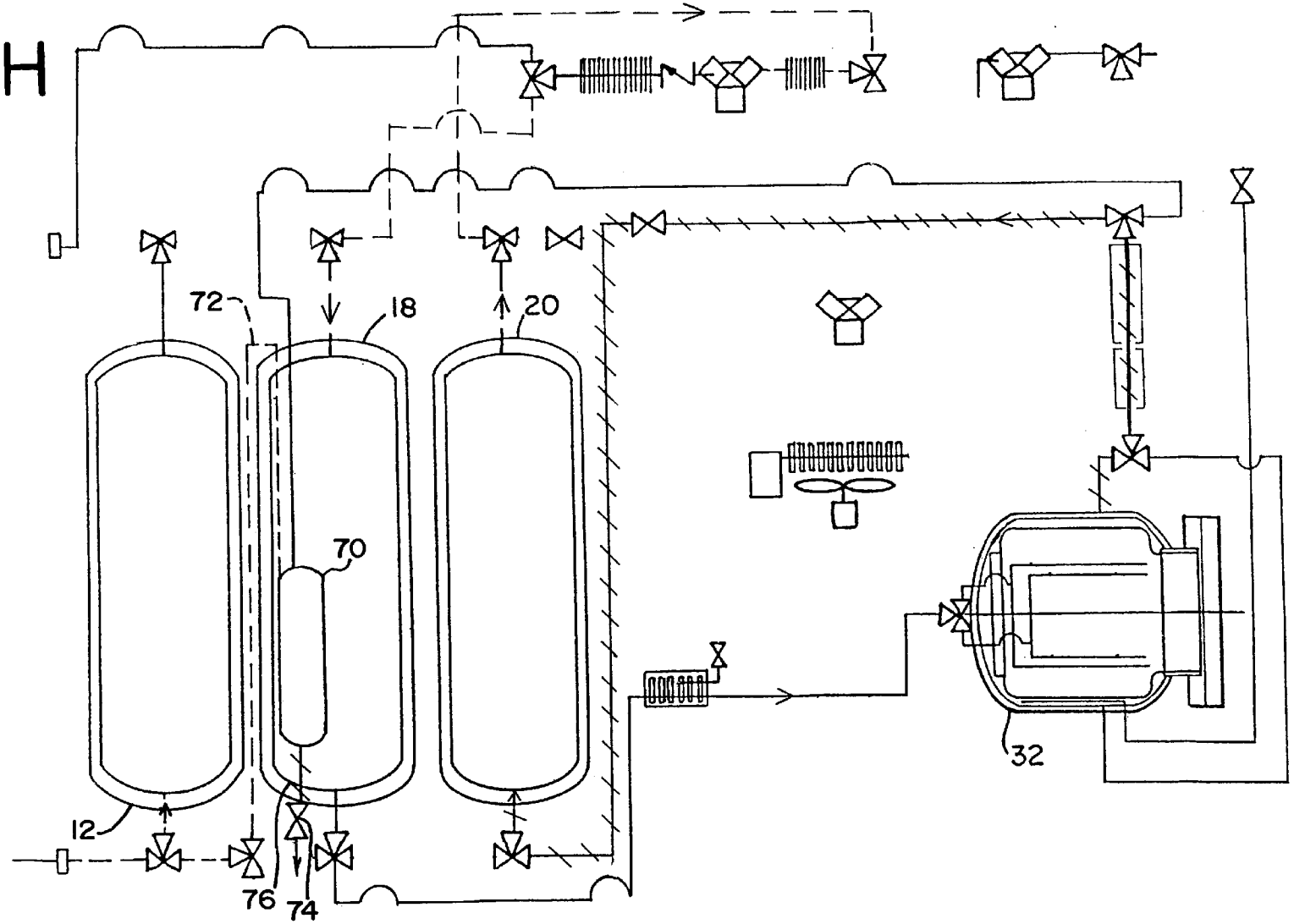
Figure 11:
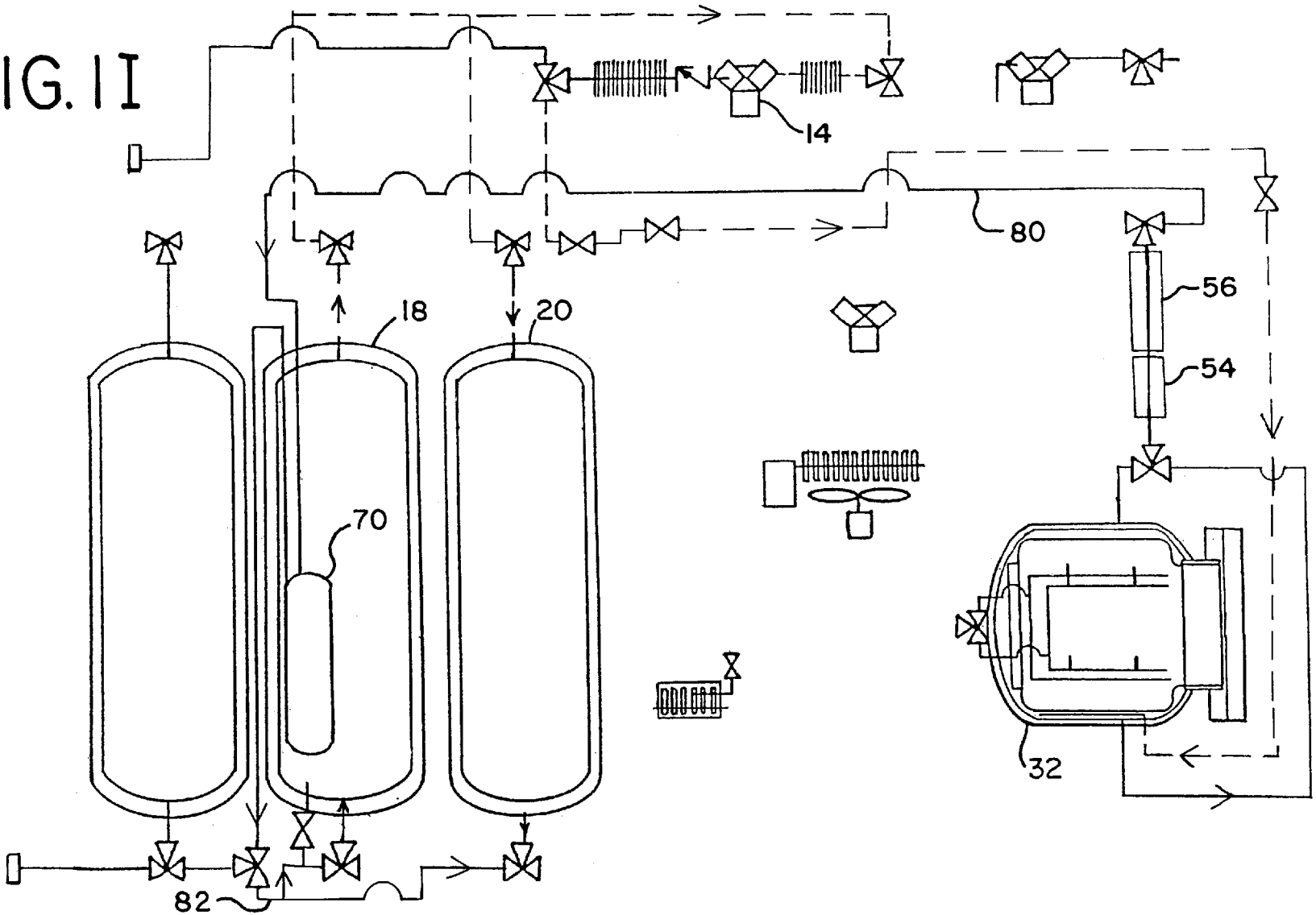

The configuration of the system during the initial portion of the agitation process is shown in FIG. 1F. The suction side of compressor 14 is connected to the top of empty storage tank 20. The discharge side of compressor 14 is connected to the head space of filled storage tank 18 so that the pressure therein is increased.

When the pressure differential between chamber 32 and storage tank 18 reaches at least 150 psi, that is, when the pressure in storage tank 18 is greater than 800 psi, high pressure liquid carbon dioxide is permitted to flow to chamber 32, as indicated by line 52. This flow is directed into chamber 32 through a first set of cleaning nozzles 53. Such nozzles are known in the art. This causes the garments and fluid in chamber 32 to rotate past the cleaning nozzles. Displaced liquid flows out of the top of chamber 32, through lint and button traps 54 and filter 56 and finally is returned to storage tank 20 at a low pressure, as indicated by cross-hatched line 58. The angles of the nozzles may optionally be adjustable from outside of the cleaning chamber 32 so that the agitation may be tailored to the specific load.

After approximately one minute, the carbon dioxide flow is terminated and the system is reconfigured as shown in FIG. 1G so that the agitation may be "reversed." More specifically, the suction side of compressor 14 is connected to the top of nearly emptied storage tank 18 while the discharge side is connected to nearly filled storage tank 20. Storage tank 20 is pressurized to over 800 psi by the flow of carbon dioxide gas.

Liquid carbon dioxide then flows out of tank 20 to chamber 32, as illustrated by line 60, where it passes through a second set of cleaning nozzles 61 that reverse the rotation of the garments. This causes the garments that have collected in the center of chamber 32 to now move to the outside where they will be subjected to the action of the cleaning nozzles. Displaced liquid flows out of the top of chamber 32 and through lint and button traps 54 and filter 56 and is returned to storage tank 18 at a low pressure, as indicated by cross-hatched line 62. The cycles of FIGS. 1F and 1G are preferably repeated approximately five to seven times for a total period of about ten to twelve minutes.

As shown in FIG. 1F, the system includes a standard refrigeration circuit, indicated generally at 64. The operation of such circuits is well known in the art. As is typical in the art, refrigeration circuit 64 features a compressor 65, fan-assisted cooling coil 66 and heat exchanger 67. Heat exchanger 67 permits refrigeration circuit 64 to cool the liquid carbon dioxide flowing to chamber 32 along line 52. As a result, heat from chamber 32 may be removed as it warms up during agitation or if it has warmed up between garment loads or overnight.

Soluble contaminants, such as soils and dyes, gradually accumulate in the liquid carbon dioxide during the agitation process and must be periodically removed. Referring to FIG. 1H, this is accomplished by still 70. Still 70, which is positioned within, for example, storage tank 18, operates during the agitation process and distills approximately 3% of the carbon dioxide in chamber 32 per load of garments.

Still 70, filled during a previous cycle in the manner described below, contains liquid carbon dioxide from chamber 32. Distillation is initiated by connecting the head space of still 70 with the liquid side of transfer tank 12. As a result, carbon dioxide gas flows to transfer tank 12 from still 70, as indicated by line 72, so that the pressure in the still is reduced. Meanwhile, as storage tanks 18 and 20 cycle through the agitation process described above, the pressure and temperature in storage tank 18 will rise so that the warmer temperature of the liquid carbon surrounding still 70 causes the liquid carbon dioxide therein to boil. As the liquid carbon dioxide in still 70 vaporizes, soil and dye residue is left behind inside the still shell. The carbon dioxide vapor flows through line 72 to transfer tank 12 where it is condensed as pure carbon dioxide.

It is necessary to drain the accumulated soil and die residue from still 70 for every garment load. This is accomplished, as shown in FIG. 1H, by opening valve 74 for approximately two seconds. This allows the pressure within still 70 to "blast" the residue out of the bottom of still, as indicated by line 76, where it is collected in a container for disposal.

After the completion of the agitation process, it is necessary to refill still 70 with liquid carbon dioxide from chamber 32. This may be accomplished in the manner illustrated in FIG. 1I. The suction side of compressor 14 is connected to the head spaces of storage tanks 18 and 20, while the discharge is connected to chamber 32. Accordingly, compressor 14 extracts gas from tanks 18 and 20 and uses it to pressurize chamber 32. As indicated by line 80, this causes the liquid carbon dioxide in chamber 32 to flow to still 70, through lint and button traps 54 and filter 56 so that still 70 is filled and pressurized to approximately 650 to 690 psi. Once still 70 is filled with liquid carbon dioxide, the remaining liquid carbon dioxide from chamber 32 is routed, via line 82 to storage containers 18 and 20. By draining chamber 32 in this manner, there is a reduced possibility of liquid entrapment or ice formation.

At this point, chamber 32 is at a pressure of about 650 psi and is empty of carbon dioxide liquid, except for a small amount trapped between the fibers of the garments. The remaining liquid in the garments may be removed in the manner illustrated in FIGS. 1J and 1K. As illustrated in FIG. 1J, the suction side of compressor 14 is connected to chamber 32, while the discharge side is connected to the head spaces of storage tanks 18 and 20. Compressor 14 is then activated so that the pressure in chamber 32 is reduced to about 420 psi. As this occurs, the pressure in storage tanks 18 and 20 is increased to about 670 psi.

Figure 1K:
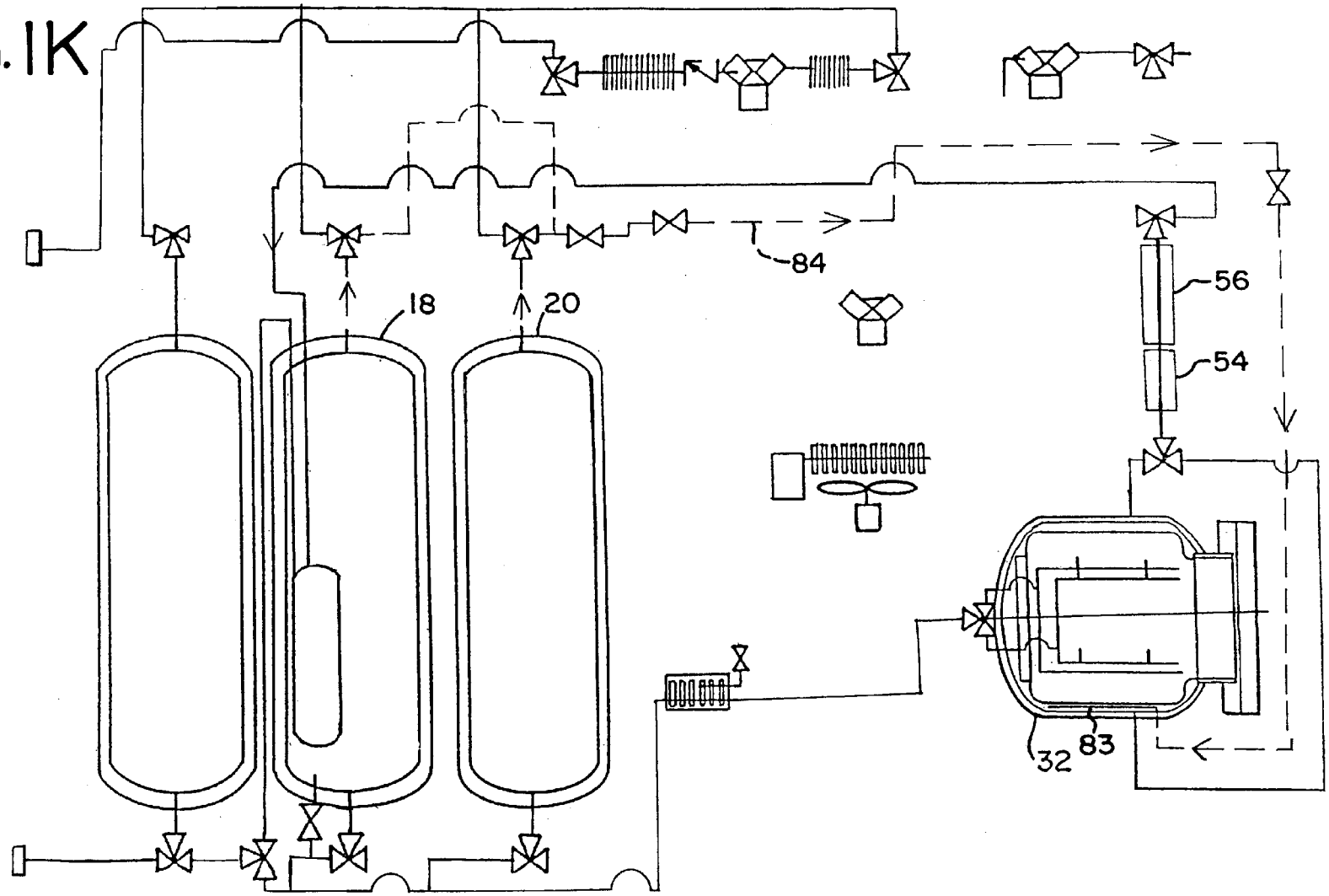
Figure 11:
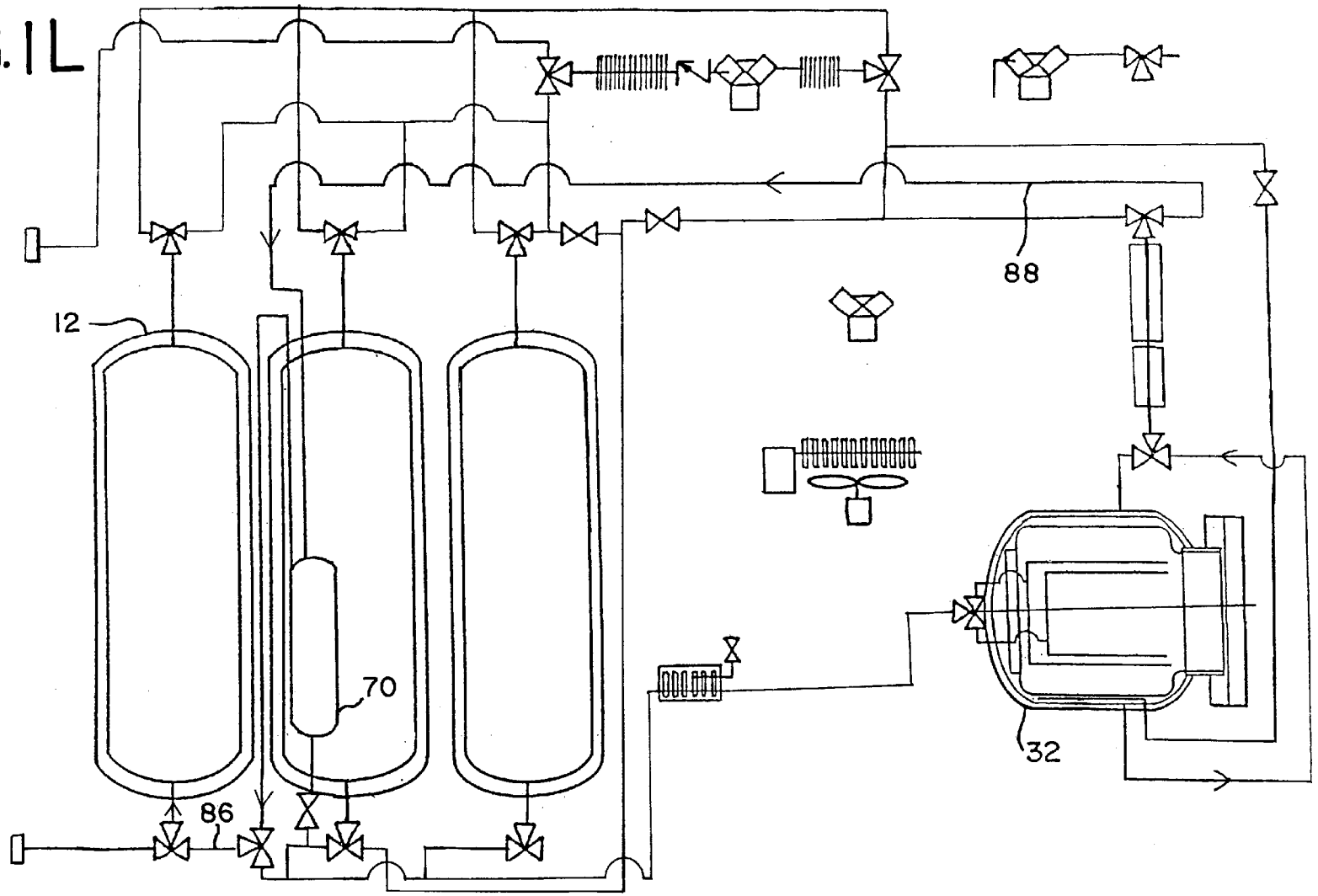

Next, as shown in FIG. 1K, the head spaces of storage tanks 18 and 20 are connected to a set of blasting jets 83 in the bottom of chamber 32. Such jets are known in the art. The approximately 250 psi pressure difference between storage tanks 18 and 20 and chamber 32 causes the latter to be repressurized with a blast of gas that passes through the jets and directly into the garments. This is illustrated by line 84 in FIG. 1K. By repeating the procedure of FIGS. 1J and 1K, the carbon dioxide liquid within the garments is removed and the garments are "fluffed." Testing has shown that two such "blasts" are usually sufficient to remove nearly all of the liquid carbon dioxide from the garments.

After the last "blast" of carbon dioxide gas, chamber 32 contains the liquid carbon dioxide removed from the garments and is at a pressure of about 650 psi. The liquid removed from the garments contains an abundance of soil and dies and thus requires distillation. To transfer this liquid to still 70, the method illustrated in FIG. 1L is employed. First, still 70 is connected to transfer tank 12. The pressure difference between the two causes a portion of the liquid carbon dioxide in still 70 to flow to transfer tank 12 as indicated by line 86. This decreases the pressure within still 70 so that it is significantly below the pressure of chamber 32. As a result, the liquid within chamber 32 is transferred to still 70 as indicated by line 88.

Referring to FIG. 1M, with the dry cleaning process now complete, chamber 32 must be depressurized so that the chamber door 34 may be opened and the garments removed. Accordingly, the suction side of compressor 14 is connected to chamber 32 while the discharge side is connected to storage tanks 18 and 20. The carbon dioxide gas within chamber 32 is then extracted and used to pressurize storage tanks 18 and 20 back up to approximately 650 to 690 psi, as indicated by lines 90 and 92. Fine screen diffusers, which are known in the art, may be placed in the bottom of the storage tanks so that the gas returned will be more efficiently diffused into the liquid. When the pressure in chamber 32 drops to 400 psi, the discharge side of compressor 14 is preferably configured via line 93 to deliver gas solely to transfer tank 12. This is done so that compressor 14 is not overloaded and heat is not produced. After chamber 32 is depressurized, the pressure therein is approximately 50 to 65 psi. At this pressure, chamber 32 contains less than 1% of the carbon dioxide that it contained when it was full. Accordingly, chamber 32 may be vented to the atmosphere, as indicated by line 94, without causing significant waste. With the chamber at atmospheric pressure, chamber door 34 may be safely opened and the garments removed.

The various configurations described above, and illustrated in FIGS. 1A through 1M, are achieved by the manipulation of a number of valves. For example, in reference to FIG. 1A, valves 102, 104 and 106 control communication with the head spaces of tanks 12, 18 and 20, respectively. Such valves are well known in the art.

Control of the system valves preferably is automated by way of a microcomputer. More specifically, the sequencing of the valves, so that the system operates as described above, is preferably controlled by a microcomputer that is responsive to signals generated by temperature, pressure and liquid level sensors positioned within tanks 12, 18 and 20 and cleaning chamber 32. The microcomputer preferably includes a timer as well that allows it to configure the valves for a predetermined period of time. Such microcomputers and their operation are known to those skilled in the art. Suitable microcomputers are available, for example, from the Z-World corporation of Davis, Calif.

Referring to FIG. 1C, for example, as carbon dioxide gas flows into chamber 32 through valve 106, and the other open valves along line 44, a sensor within chamber 32 monitors the pressure therein. When this pressure sensor detects that the pressure within chamber 32 has risen to 70 psi, it sends a signal to a microprocessor which in turn closes valve 106, and the other valves along line 44, so that the flow of carbon dioxide gas into chamber 32 ceases.

As another example, as agitation is being performed in the manner illustrated in FIG. 1F, a timer tracks the time interval. When one minute has passed, the timer signals a microprocessor which then reconfigures the valves to the arrangement shown in FIG. 1G so that agitation may be reversed. Alternatively, pressure sensors positioned within storage tank 18 and cleaning chamber 32 may signal a microprocessor to reconfigure the system valves to the arrangement shown in FIG. 1G when a pressure drop across the cleaning nozzles 53 (FIG. 1F) occurs. A pressure sensor positioned in storage tank 20 may be used in combination with the pressure sensor in the cleaning chamber to accomplish a similar function.

Figure 2:
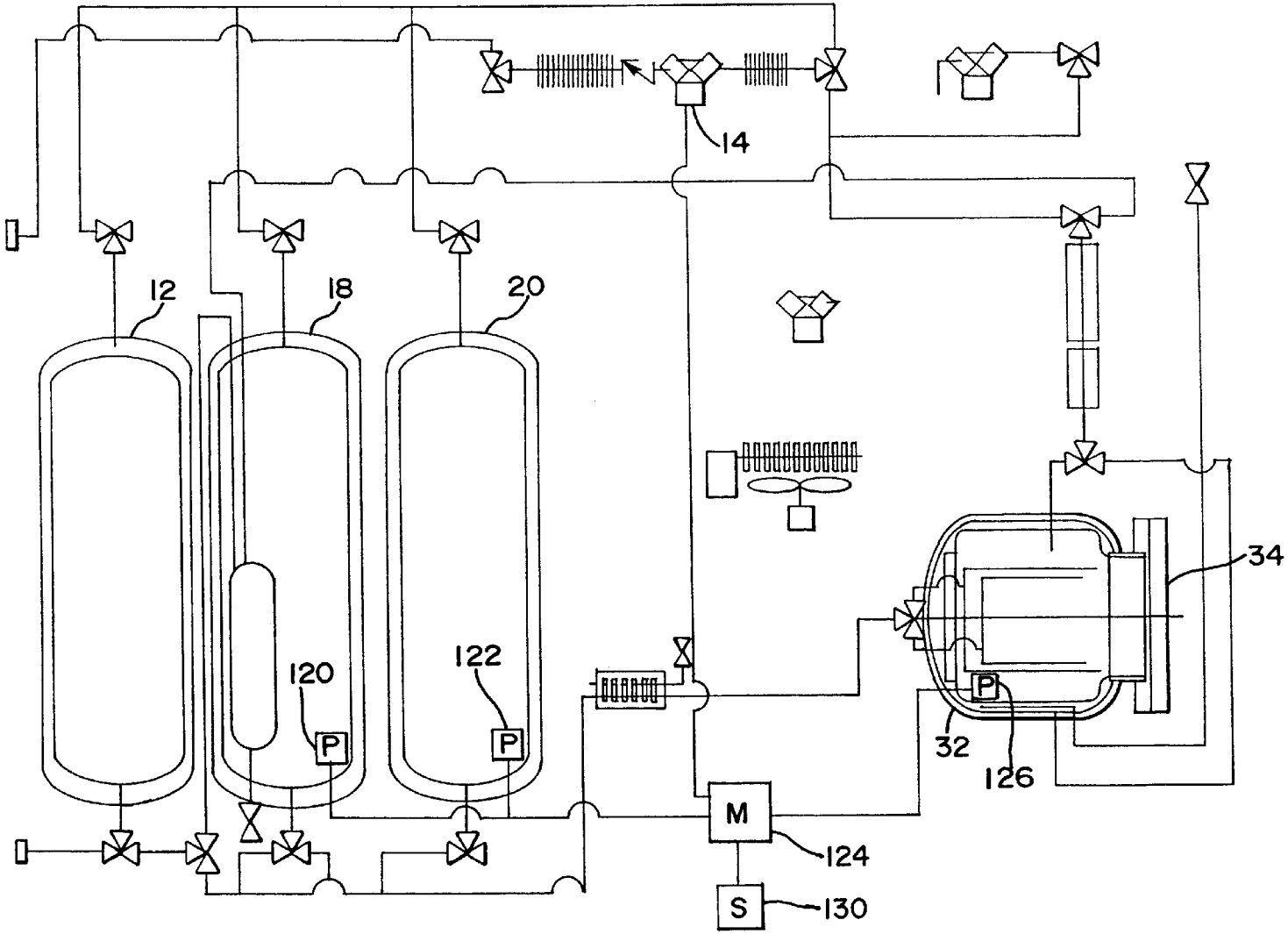
FIG. 2 is a schematic diagram of the system of FIGS. 1A–1M showing the agitation pressure control system.

The pressure sensors within the storage tanks 18 and 20 and cleaning chamber 32 may also be utilized to control the pressure across the nozzles 53 (FIG. 1F) and 61 (FIG. 1G), that is, the agitation pressure, so that delicate fabrics or objects are not damaged during agitation. This may be accomplished using the agitation control system illustrated in FIG. 2. The pressure sensors 120 and 122 in tanks 18 and 20, respectively, are in communication with a control means such as microprocessor 124. The control means may alternatively take the form of a process controller such as those made by the Allen Bradley Company or a similar device. A pressure sensor 126 in cleaning chamber 32 is also in communication with the microprocessor. A selector means such as switch 130 allows an operator to select, for example, a fabric setting that is communicated to the microprocessor. During the agitation cycle, the microprocessor adjusts the loading of the compressor 14 based upon the setting of switch 130 so that the pressure differential between the tanks 18 and 20, when pressurized, and the chamber 32 is controlled. As a result, the pressures from the nozzles in the cleaning chamber are controlled.

As is known in the art, differential pressure gauges may be utilized to determine the liquid levels within the storage tanks 18 and 20. When liquid carbon dioxide under high pressure is contained within the storage tanks, however, condensation may form in the normally gas-filled external tubes of the differential pressure gauges so as to provide erroneous readings. To prevent this problem, the external tubes of the differential pressure gauges may be equipped with heaters in communication with temperature controllers. Heating the external tubes prevents the condensation.

The system of FIGS. 1A through 1M offers significant advantages over other carbon dioxide dry cleaning systems. The system moves the liquid carbon dioxide without the use of pumps, instead relying upon a single compressor to pressurize the appropriate carbon dioxide storage tanks with carbon dioxide gas. The density of gaseous carbon dioxide is only about one-sixth of the density of liquid carbon dioxide at the pressures involved. As a result, much less mass is moved by the compressor in motivating the liquid carbon dioxide than if pumps moved the liquid directly. By handling less mass, the compressor suffers less wear and thus offers greater reliability and lower maintenance requirements as compared to cryogenic pumps. In addition, such compressors generally cost less than pumps.

The still 70 is advantageous over the distillation apparatus of other carbon dioxide dry cleaning systems in that it does not employ an electric heater or a heat exchanger. This increases its reliability while decreasing its cost and maintenance requirements.

Figure 3A:
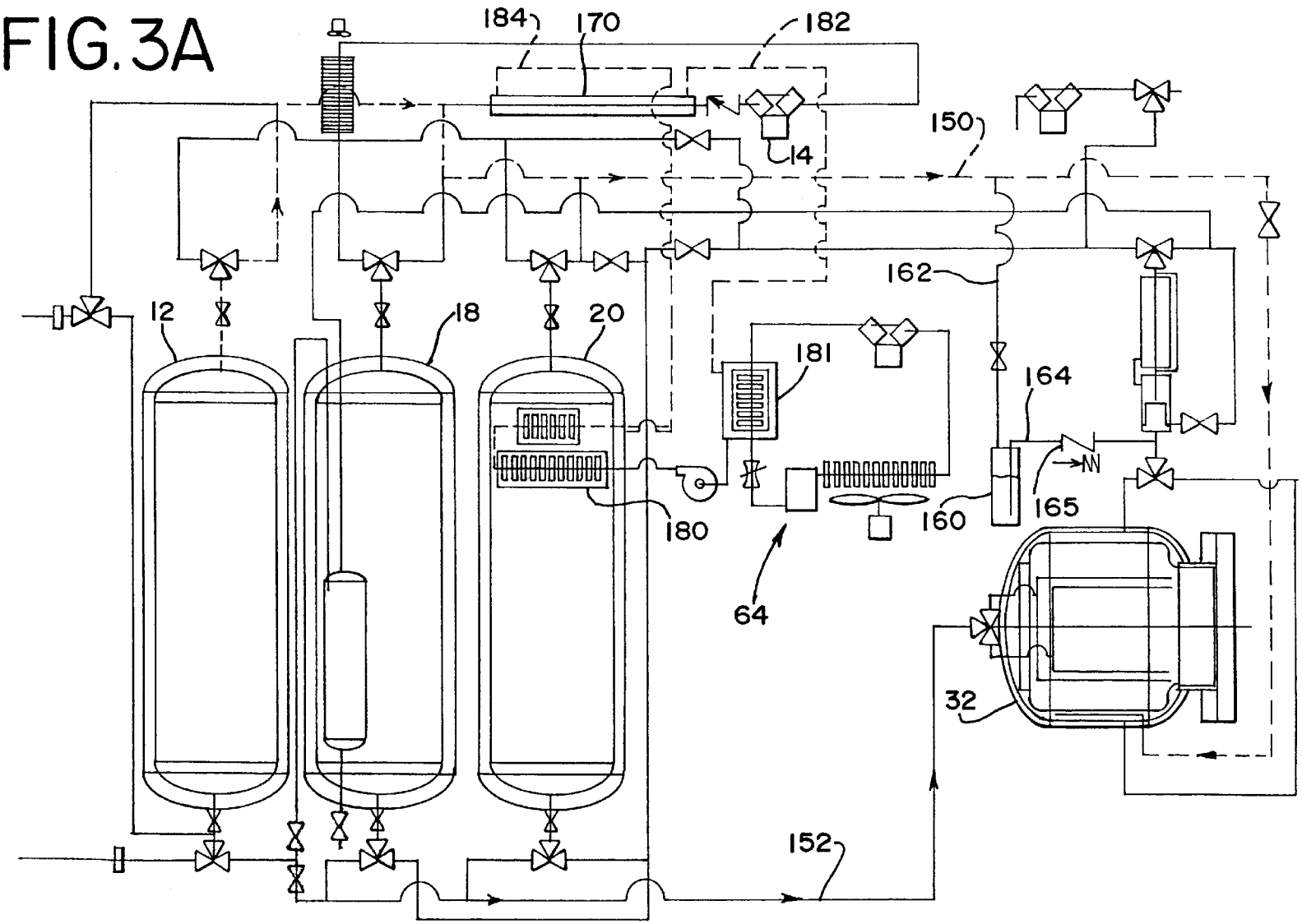
FIGS. 3A and 3B are schematic diagrams of a second embodiment of the carbon dioxide dry cleaning system of the present invention including a heat sink, recondensing coils in one of the storage tanks and a solvent additive dispenser.
Figure 3B:
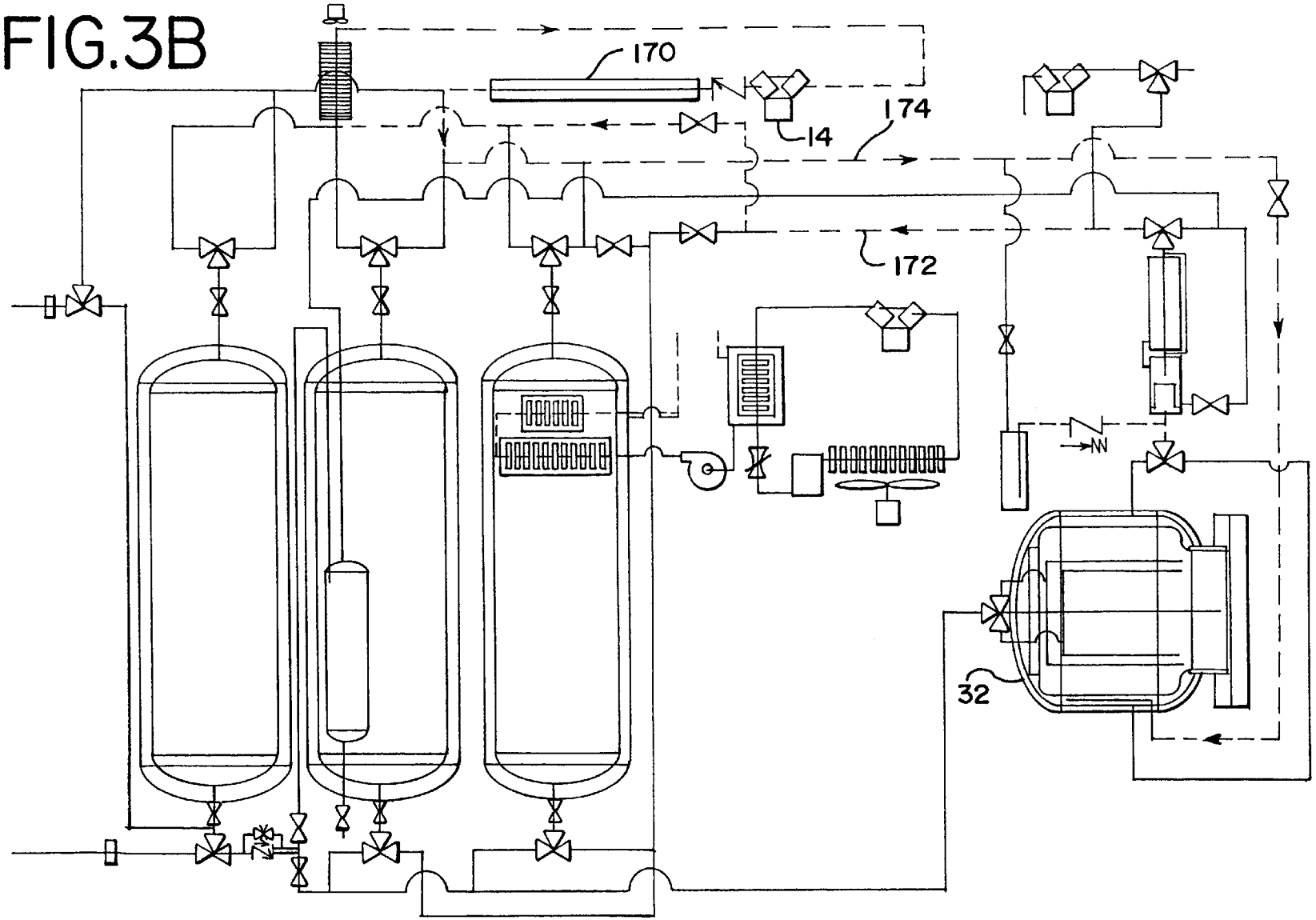

FIGS. 3A and 3B show a second embodiment of the system of the present invention. With the exception of the features discussed below, the system of FIGS. 3A and 3B operates in the same manner as the system of FIGS. 1A–1M. Accordingly, components that are common between FIGS. 3A and 3B and FIGS. 1A–1M will feature the same reference numbers.

As described earlier in reference to FIG. 1C, the head space of either storage tank 18 or 20 may be temporarily connected to the cleaning chamber 32. As a result, the cleaning chamber is pressurized so that it may be filled with liquid carbon dioxide without the formation of dry ice or the occurrence of thermal shock. Alternatively, as illustrated by line 150 in FIG. 3A, the head space of transfer tank 12 may be connected to the cleaning chamber 32 to accomplish the same result. In addition, as illustrated by line 152, liquid carbon dioxide from the transfer tank may be added to the cleaning chamber. This may be done at the beginning of a cleaning cycle, that is, immediately after the processes illustrated in FIG. 1C or by line 150 in FIG. 3A, to replenish the solvent lost during the previous cleaning cycle. As a result, solvent may be added to the system without the use of a pump or compressor.

Additives for enhancing cleaning such as surfactants, anti-static agents, detergents and deodorants may be injected into the liquid carbon dioxide via the solvent additive dispenser indicated at 160 in FIG. 3A. The dispenser contains a supply of additive with a head space thereabove. The dispenser head space may be placed in communication with the head space of either storage tank 18 or 20 via line 162. The liquid side of the dispenser may be accessed either internally by a dip tube or externally through a port so that the additive may travel through line 164. As a result, during agitation (FIG. 1F), the dispenser is pressurized as tank 18 (for example) is pressurized so that additive is injected into the liquid carbon dioxide traveling from the cleaning chamber 32 to storage tank 20.

As illustrated in FIG. 3A, line 164 features a check valve 165 that prevents liquid carbon dioxide from reaching the additive dispenser 160. This prevents the formation of dry ice in the additive dispenser 160 when the dispenser is depressurized for replenishment of the solvent additive.

As indicated at 170 in FIG. 3A, a heat sink is connected to the outlet of the compressor 14. Heat from the compressed carbon dioxide gas exiting the compressor is transferred to the heat sink during the agitation (FIGS. 1F and 1G) and chamber pressure reduction (FIG. 1J) cycles. As a result, the carbon dioxide gas is cooled before it enters storage tanks 18 and 20. The undesired heating of the solvent in the storage tanks is therefore minimized.

The interior of the cleaning chamber is cooled as a result of the pressure reduction of FIG. 1J. Carbon dioxide gas within the cleaning chamber may be circulated through the heat sink 170 and returned to the cleaning chamber, as illustrated by lines 172 and 174 in FIG. 3B. The circulated carbon dioxide gas is warmed by the heat sink so that the interior of the chamber is warmed. As a result, the removal of solvent from the cleaning chamber contents is enhanced. Heat sink 170 therefore acts as a "thermal battery" by storing the heat from previous cycles for use in warming the cleaning chamber. The compressor 14 is run at very low compression during this circulation.

As explained in reference to FIG. 1F, a refrigeration circuit 64 may be used to cool liquid carbon dioxide as it flows to the cleaning chamber. This allows the chamber to be cooled if it has warmed up between garment loads or overnight. Alternatively, as illustrated in FIG. 3A, a recondensing coil 180 may be placed within storage tank 20. The recondensing coil communicates with the refrigeration circuit 64 via a heat exchanger 181. This allows the liquid carbon dioxide within storage tank 20 to be cooled before it is transferred to the cleaning chamber. As a result, the cleaning chamber is cooled as it receives the cooled liquid carbon dioxide. As indicated by lines 182 and 184, the heat sink 170 may also communicate with the refrigeration circuit 64 via heat exchanger 181. This allows the temperature of the heat sink to be controlled.

Figure 4:
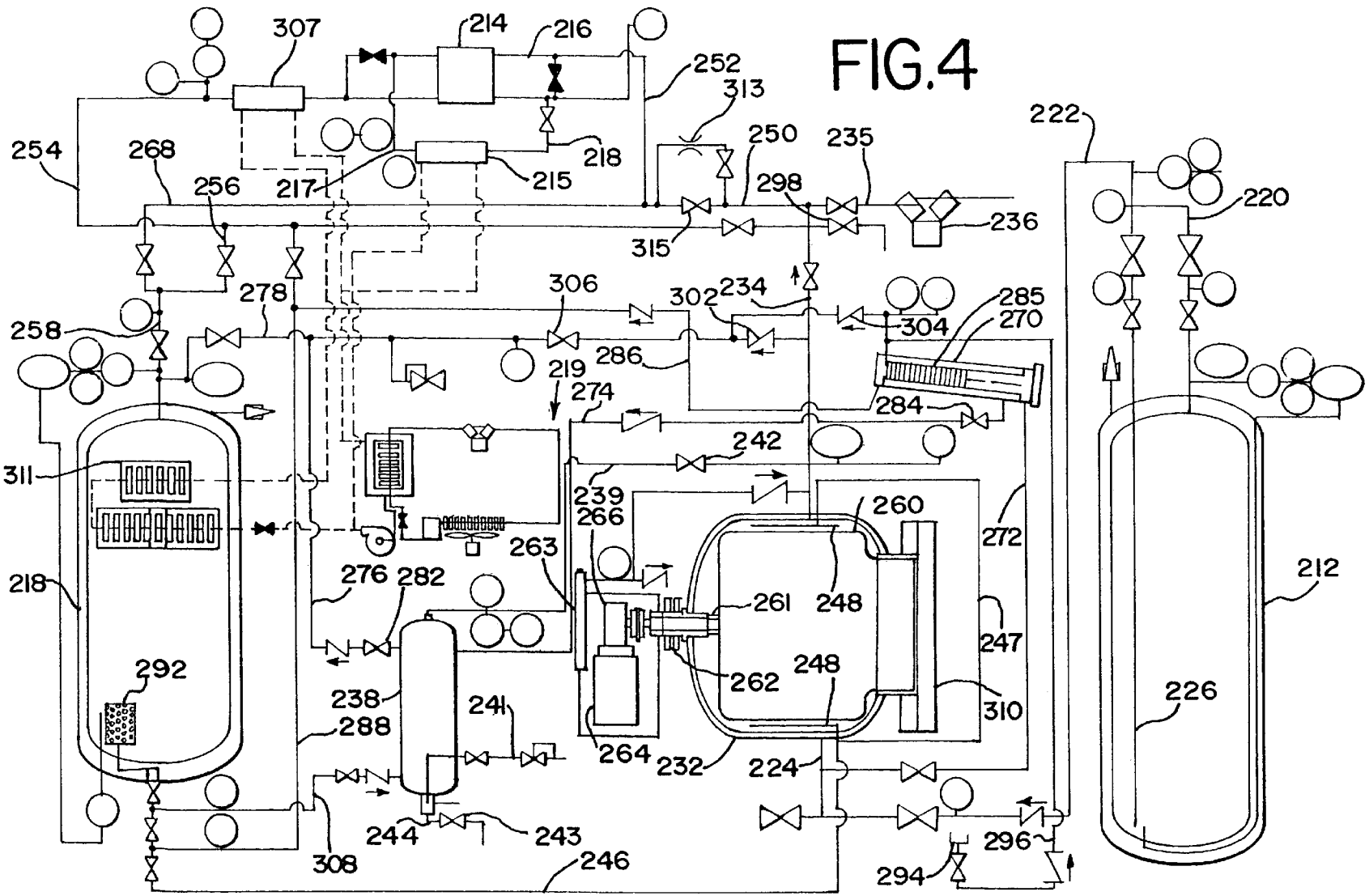
FIG. 4 is a schematic diagram of a third embodiment of the carbon dioxide dry cleaning system of the present invention.

In FIG. 4, a third embodiment of the carbon dioxide dry cleaning system of the present invention is shown. A cold transfer tank 212 contains a supply of liquid carbon dioxide, preferably with cleansing additives, at a pressure of about 200 to 50 psi. Transfer tank 212 may be refilled from a mobile delivery tank in a conventional manner.

A cleaning or wash chamber 232 contains soiled garments and has a volume less than that of a storage tank 218. To commence the dry cleaning process, most of the air in chamber 232 must be evacuated to prevent the addition of water to the cleaning fluid. This is accomplished through line 234 and vacuum compressor 236.

Chamber 232 is then pressurized to an intermediate pressure of approximately 70 psi by communication with the head space of external still 238 which, as will be explained below, contains carbon dioxide vapor at a pressure of approximately 800 psi. The head space of still 238 and the wash chamber 232 communicate via lines 239 and 234. A steam supply line 241 is in communication with a source of steam (not shown) and the still 238. As a result, heat is supplied to the still so that its pressure may be increased back to approximately 800 psi after vapor is transferred to the wash chamber 232. Alternative forms of heating the still, such as an electric blanket or heater, may alternatively be used. Wash chamber 232 may alternatively be pressurized to an intermediate pressure by communication with the head space of transfer tank 212 via lines 220, 222 and 224.

Once chamber 232 is pressurized to an intermediate pressure, liquid carbon dioxide may be transferred thereto from transfer tank 212 via dip tube 226 and lines 222 and 224 to make up for liquid carbon dioxide lost during previous cycles.

After the system is replenished with liquid carbon dioxide, the head space of still 238 is once again placed in communication with chamber 232 via lines 239 and 234. The resulting reduction in pressure in still 238 causes the liquid carbon dioxide therein to boil so that nearly no liquid remains and vapor is transferred to the chamber 232 until the pressures within the two equalize at approximately 420 psi. This procedure allows chamber 232 to be pressurized without lowering the temperature or pressure of the fluid stored in storage tank 218. The steam supply line 241 may be operated to assist in vaporizing all of the liquid within still 238. Once chamber 232 is pressurized, valve 242 is closed to isolate still 238 from chamber 232.

The residue of soluble contaminants, such as soils and dyes, collect in the bottom of the still 238 as the liquid carbon dioxide therein boils. This residue may removed by periodically opening valve 243 after all of the liquid has been transferred to the chamber. The pressure within the still forces the residue out of line 244 when valve 243 is opened.

Chamber 232 next is partially filled with a quantity of liquid carbon dioxide that is slightly less than the capacity of still 238. As an example only, still 238 may have a capacity of approximately 17 gallons. This partial fill of the chamber 232, which is done in preparation for the prewash cycle, is done in two steps: the gentle step and the vigorous step. During the gentle step, the liquid side of storage tank 218 is placed in communication with the interior of chamber 232 via lines 246 and 247 and nozzles 248. The pressure difference between tank 218 and chamber 232 then causes the liquid carbon dioxide to flow to the latter.

The prewash fill is completed during the vigorous step by connecting chamber 232 to the suction side of a compressor 214 via lines 234, 250 and 252 and the discharge side to the head space of storage tank 218 via lines 254, 256 and 258. This allows gas to be extracted from chamber 232 and storage tank 218 to be pressurized. The resulting pressure difference causes liquid carbon dioxide to flow from storage tank 218 to chamber 232 through lines 246 and 247 and nozzles 248. The flow of liquid carbon dioxide into chamber 232 through nozzles 248 agitates the garments or other objects in chamber 232 such that insoluble soils are removed. Upon completion of the prewash fill, chamber 232 is contains liquid carbon dioxide at a pressure of about 650 to 690 psi and a temperature of about 54° F. (a temperature at which it is an effective solvent).

To provide a greater variety and more accurate pressurization, compressor 214 may optionally be a two-stage compressor. Gas travels to the inlet of the first stage of compressor 214 through line 216. If second stage compression is desired, gas exiting the first stage is directed through line 217 where heat exchanger 215 is encountered. Heat exchanger 215 allows the gas traveling to the second stage of the compressor to be cooled or heated if necessary. Line 218 carries the gas from the heat exchanger 215 to the inlet of the second stage of the compressor. Gas ultimately exits the compressor through line 254. The temperature of heat exchanger 215 may be controlled via a connection with a refrigeration circuit, indicated in general at 219.

A basket 260 is rotatably mounted within chamber 232 via a shaft 261 that is supported by a bearing cartridge 262. Preferably, the bearing cartridge 262 includes a leak detection and management system 263 as described in pending U.S. application Ser. No. 09/716,098 which is also owned by the present assignee. A motor 264 is activated to turn the rotating basket 260 via a drive mechanism 266 so that the garments may undergo further agitation so that additional insoluble soils are removed therefrom. Suitable drive mechanisms 266 are known in the art and include gear, shaft, belt and chain arrangements. During the prewash cycle, the rotating basket preferably is operated at a speed of approximately thirty revolutions per minute for approximately one minute.

After the prewash cycle, the suction side of compressor 214 is connected to the head space of still 238 via lines 276, 278, 258, 268 and 252. The discharge side of compressor 214 is connected to chamber 232 via lines 254 and 234. The bottom of chamber 232 is connected to the inlet side of a filter 270 by lines 224 and 272. A filter bypass line 274 runs from the inlet side of the filter to the head space of still 238. Upon operation of compressor 214, all of the liquid carbon dioxide in chamber 232 is transferred to still 238 in an unfiltered condition. As a result, still 238 contains liquid carbon dioxide at a pressure of approximately 700 psi and drained chamber 232 is at a pressure of approximately 700 psi.

After the chamber 232 has been drained, still 238 is isolated from the head space of storage tank 218 and filter 270 through closure of valves 282 and 284, respectively. As will be explained below, carbon dioxide gas is introduced into still 238 during the chamber pressure reduction cycle to bring the pressure therein up to approximately 800 psi. As a result, still 238 is prepared for use and distillation during the prewash cycle for the next load of garments to be cleaned.

The first wash cycle is initiated by again connecting chamber 232 to the suction side of compressor 214 and the discharge side of the compressor to the head space of the storage tank 218. The bottom of storage tank 218 is placed in communication with wash chamber 232 via lines 246 and 247 and nozzles 248. Upon activation of the compressor, the garments within chamber 232 are agitated via nozzles 248 as the chamber is refilled to a level of approximately one-half to two-thirds full with liquid carbon dioxide at a pressure of about 650 to 690 psi and a temperature of about 54° F. The basket 260 is again rotated to agitate the garments therein further at a speed of, for example, thirty revolutions per minute. Preferably, the basket rotation/agitation occurs for a period of roughly four minutes.

Upon completion of the first wash cycle, the suction and discharge sides of compressor 214 are again connected to the head spaces of storage tank 218 and chamber 232, respectively. The bottom of chamber 232 is placed in communication with the inlet side of filter 270. Valve 284 in bypass line 274 remains closed. As a result, all of the liquid from the chamber 232 is directed through the filter 270 and the charcoal bed 285 positioned therein. The charcoal bed 285 removes dyes and odors from the liquid carbon dioxide. The filtered liquid carbon dioxide exits the filter outlet side and travels to the bottom of storage tank 218 via lines 286, 288 and 246. A diffuser 292 is used to disperse the filtered liquid as it rejoins the liquid remaining in tank 218.

A detergent dispenser 294 communicates with the outlet side of filter 270 via line 296. As liquid carbon dioxide drained from chamber 232 passes through filter 270, a venturi effect causes detergent to be withdrawn from dispenser 294. This detergent travels through line 296 and is added to the stream of liquid carbon dioxide exiting filter 270. The injection of detergent, or other additives such as softeners, downstream of filter 270 allows for complete mixing of the detergent and liquid carbon dioxide as it travels towards and into storage tank 218.

Four additional wash cycles of the type described above preferably are performed. No detergent is added, however, during the drain of liquid carbon dioxide from the wash chamber after the fourth/last wash cycle.

During one or more of the wash cycles, an operation whereby the liquid carbon dioxide in chamber 232 is warmed may optionally be performed. This warming operation is performed during the agitation stage of a wash cycle. The head space of tank 218 is connected to the suction side of compressor 214 via lines 258, 268 and 252. The discharge side of compressor 214 is connected to the nozzles 248 of wash chamber 232 via lines 254, 288, 246 and 247. With the system placed in this configuration, operation of the compressor reduces the pressure within tank 218 so that the liquid therein boils. The vapor produced thereby is withdrawn from tank 218 by compressor 214 and introduced into chamber 232 through nozzles 248. As a result, the liquid carbon dioxide within chamber 232 is pressurized to approximately 840 psi and warmed to approximately 70° F. At this temperature and pressure, the solvent properties of the liquid carbon dioxide and detergent within chamber 232 are enhanced.

An added benefit of the warming operation is that the temperature and pressure of the liquid carbon dioxide remaining in tank 218 are both decreased. This compensates for the return of the warm solvent gas from chamber 232 during the drainage stage of the wash cycle. In other words, the warming of the liquid in chamber 232 is offset by the cooling of the liquid within tank 218 so that the overall system temperature remains balanced.

In the event of a system malfunction during the wash cycle, the valves leading to and from the wash chamber 232 may be closed. If this occurs when the wash chamber is nearly full of liquid carbon dioxide, the pressure therein could build very rapidly. The system is equipped with a main pressure relief valve 298 that permits the chamber to vent to the exterior of the plant that houses the system. The main pressure relief valve 298 opens when the pressure within the wash chamber 232 reaches 1000 psi. This produces a very loud and unnerving sound, however.

In order to maintain protection from over-pressurization of the wash chamber, but to prevent the activation of the main pressure relief valve, the system is provided with a pressure relief valve, such as spring-loaded check valve 302, that is positioned within line 278. Line 278, when check valve 302 is open, permits solvent to flow from the head space of chamber 232 to the head space of supply tank 218. The system also includes a pressure relief valve, such as spring-loaded check valve 304, that is positioned in circuit between the outlet side of filter 270 and the line 278 leading to the head space of supply tank 218. Spring-loaded check valve 304 prevents over-pressurization of filter 270 due to liquid carbon dioxide that may trapped therein.

Both spring-loaded check valves 302 and 304 are set to open when the pressures on their inlet (chamber and filter, respectively) sides become approximately 100 psi higher than the pressure on their outlet/supply tank sides. Given that the pressure in supply tank 218 is approximately 700 psi, the spring-loaded check valves 302 and 304 limit the pressures in the chamber and filter, respectively, to approximately 800 psi. As such, both check valves 302 and 304 will operate before main pressure relief valve 298.

As described above, during the warming operation that may optionally be performed during the agitation stage of a wash cycle, the pressure of the liquid carbon dioxide within the chamber 232 may be increased to 840 psi. Accordingly, when the optional warming operation is performed, check valve 302 must be disabled so that it does not open. This may be accomplished by closing valve 306 in line 278.

After the last wash cycle, two rinse cycles are performed using the same procedure except that agitation is performed only for approximately one minute during each of the rinse cycles and no detergent is added during drainage of the wash chamber.

A heat exchanger 307 communicates with the outlet of compressor 214 and is heated by gas exiting the compressor during the liquid fills of chamber 232. As a result, the gas traveling to storage tank 218 is cooled to minimize the undesired heating of the liquid carbon dioxide stored therein. As described with respect to FIG. 3A, the refrigeration circuit 219 may be used to control the temperature of heat exchanger 307.

After the second rinse cycle, the wash chamber 232 is at a pressure of approximately 650 psi and is empty of carbon dioxide liquid, except for a small amount trapped between the fibers of the garments. The remaining liquid in the garments is removed by a spin cycle during which the basket 260 containing the garments preferably is rotated at approximately 180 rpm for approximately two minutes.

The head space of supply tank 218 is again connected to the suction side of compressor 214 while the discharge side of the compressor is connected to the head space of chamber 232. The bottom of chamber 232 is connected to the bottom/liquid side of tank 218 with filter 270 in circuit there between. As a result, operation of compressor 214 forces the liquid removed from the garments out of chamber 232, through filter 270 and to tank 218.

The system is configured to recirculate the gas within chamber 232 and warm its interior and contents by connecting the head space of the chamber to the suction side of compressor 214. The discharge side of compressor 214 is connected to the nozzles 248 of the chamber via lines 254, 288, 246 and 247. Operation of compressor causes gas to be withdrawn from chamber 232 and directed to the heat exchanger 307 where it is warmed. The warmed gas is then delivered into the chamber through the nozzles so that the garments within the chamber are "fluffed." The basket 260 within the chamber may optionally be rotated so that the fluffing of the garments is enhanced. The gas recirculation/fluffing cycle preferably is performed for approximately two minutes.

The gas recirculation/fluffing cycle may optionally be enhanced by providing a flow restrictor such as orifice 313. As illustrated in FIG. 4, flow restrictor 313 may be placed in parallel with valve 315 so that valve 315 may be closed to force gas through the restrictor. With the system of FIG. 4 thus configured, gas withdrawn from chamber 232 encounters the flow restrictor 313 prior to entering compressor 214. As a result, compressor 214 must work harder to circulate the gas. This causes the compression ratio between the gas entering the compressor and that leaving the compressor to be high enough that the temperature of the gas is raised significantly. Accordingly, warmer gas is delivered to the chamber 232 for enhanced fluffing. The decompression that occurs across the flow restrictor 313 cools the gas slightly as it travels there through. Heat exchanger 215 may be used to warm the gas slightly as is travels to the second stage of the compressor to offset the temperature decrease across flow restrictor 313.

The pressure within chamber 232 must be decreased to atmospheric before the cleaned garments may be removed. This is accomplished by connecting the head space of chamber 232 to the suction side of compressor 214 and the discharge side of the compressor to the liquid side of still 238 via lines 254, 288, 246 and 308. The compressor then withdraws gas from chamber 232 and delivers it to still 238 until the pressure within the latter is raised to approximately 800 psi. The carbon dioxide gas from the compressor is then redirected to the liquid side of tank 218 and diffuser 292. As a result, the carbon dioxide gas from chamber 232 is bubbled into the liquid carbon dioxide of tank 218 until the pressure within tank 218 is increased to approximately 650 to 690 psi.

As explained with respect to FIG. 3A, recondensing coils 311 may be positioned within the head space of storage tank 218. The recondensing coils communicate with the refrigeration circuit 219. As a result, the coils cool the gas that has traveled through the liquid to the head space after delivery to the liquid side of tank 218 during the gas recovery/despressurization cycle. This allows the pressure and temperature within tank 218 to be controlled.

After chamber 232 is depressurized, the pressure therein is approximately 50 to 60 psi. This remaining pressure may be safely vented to the atmosphere via lines 234 and 235. The chamber door 310 may then be safely opened and the garments removed.

Figure 5:
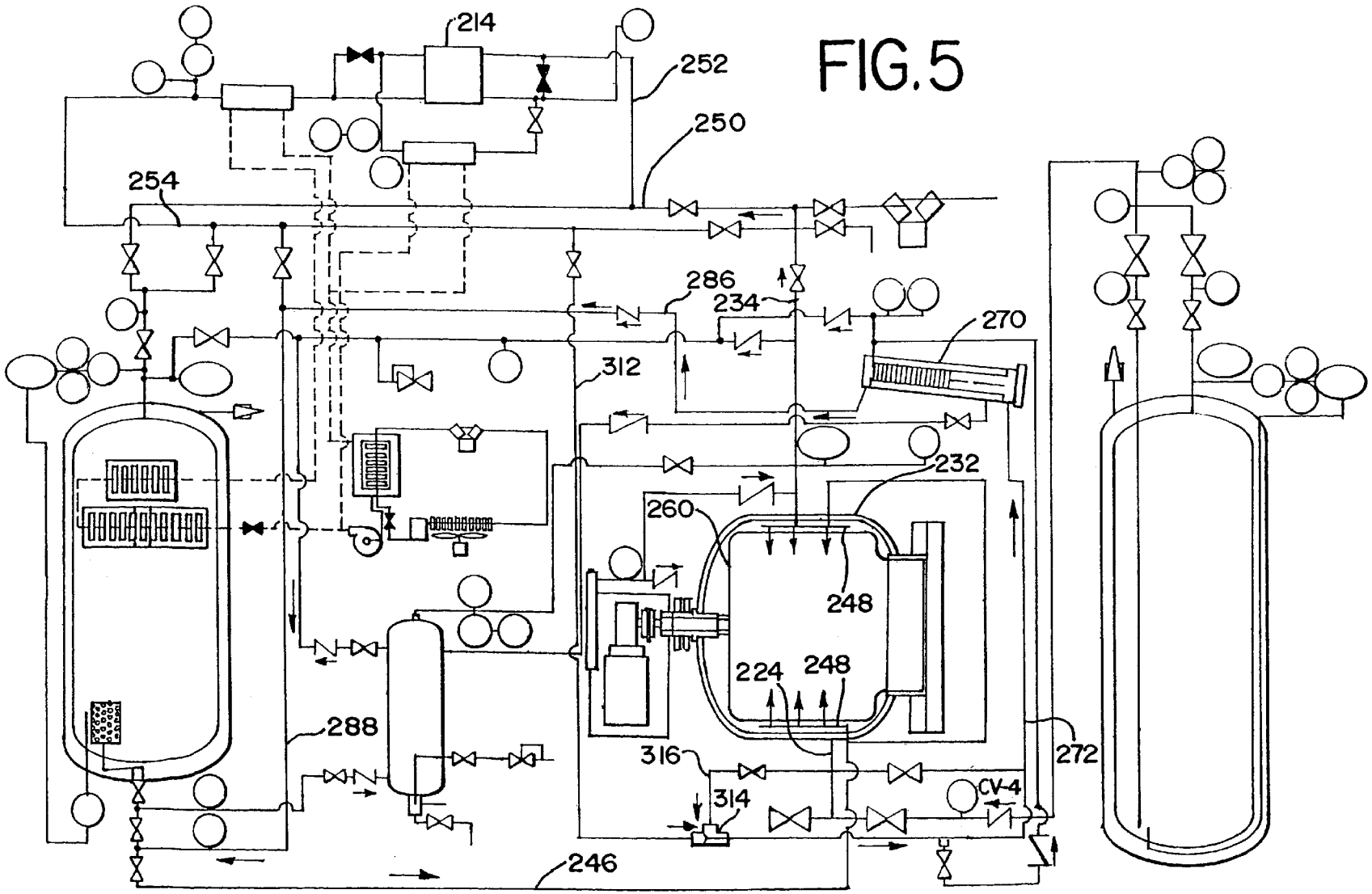
FIG. 5 is a schematic diagram of a fourth embodiment of the carbon dioxide dry cleaning system of the present invention.

FIG. 5 illustrates the system of FIG. 4 with the addition of components that allow for constant filtration of the liquid carbon dioxide during the wash cycle. More specifically, a line 312 has been added between lines 254 and 272. A venturi or eductor 314 is positioned within line 312 and communicates with line 224 via line 316.

As described previously, during the wash cycle, wash chamber 232 is approximately one-half to two-thirds full with liquid carbon dioxide at a pressure of about 650 to 690 psi and a temperature of about 54° F. The basket 260 is rotated to agitate the garments therein. To provide constant filtration of the liquid carbon dioxide therein, the top of chamber 232 is connected via lines 234, 250 and 252 to the suction side of compressor 214 while the discharge side of compressor 214 is placed in communication with lines 254 and 312. As a result, gas is withdrawn from the head space of chamber 232 and is directed through eductor 314.

Liquid carbon dioxide is withdrawn from the bottom of chamber 232 via lines 224 and 316 and mixes with the carbon dioxide gas flowing through eductor 314. The liquid, propelled by the flow of liquid carbon dioxide gas, travels to filter 270 via line 272. The filtered liquid travels through lines 286, 288 and 246 to nozzles 248 whereby it is reintroduced into chamber 232.

Figure 6:
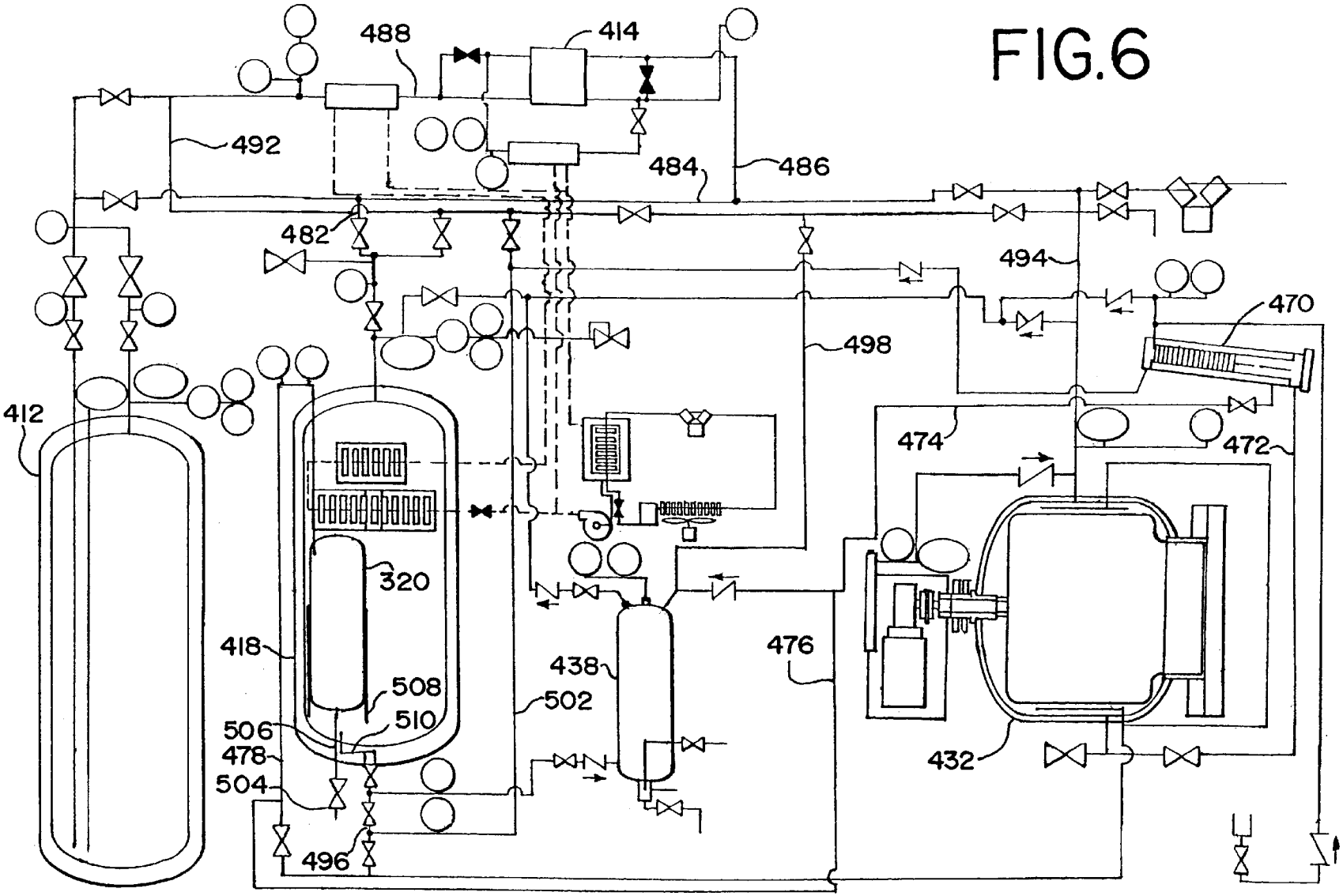
FIG. 6 is a schematic diagram of a fifth embodiment of the carbon dioxide dry cleaning system of the present invention.

A fourth embodiment of the system of the present invention is illustrated in FIG. 6. This embodiment includes generally all of the components of the embodiment of FIG. 4 with the addition of a still 320 positioned within the storage tank 418. The system of FIG. 6 operates in the same manner as the system of FIG. 4 with the exception that after the second/last rinse cycle, the liquid carbon dioxide drained from the wash chamber 432 is directed to the internal still 320.

The system of FIG. 6 performs prewash, wash and rinse cycles in the manner described for the system of FIG. 4. This includes the replenishment of liquid carbon dioxide to the system from transfer tank 412, transfer of liquid carbon dioxide between storage tank 418 and wash chamber 432 by compressor 414 and drain after a prewash cycle to an external still 438.

After the agitation of the second and final rinse cycle has been completed, the bottom of wash chamber 432 is connected to the inlet side of filter 470 by line 472. In addition, the inlet side of filter 470 is placed in communication with the head space of internal still 320 via lines 474, 476 and 478. The suction side of compressor 414 is connected to the head space of storage tank 418 via lines 482, 484 and 486. The discharge side of compressor 414 is connected to chamber 432 via lines 488, 492 and 494. Accordingly, compressor 414 extracts gas from tank 418 and uses it to pressurize chamber 432. This causes the liquid carbon dioxide in chamber 432 to flow through line 472, the inlet side of filter 470 and lines 474, 476 and 478 to the internal still 320 so that it is filled with liquid carbon dioxide at a pressure of approximatley 650 to 690 psi. Once the still is filled, the remaining liquid carbon dioxide from chamber 432 is directed to the liquid side of storage tank 418 via lines 478 and 496.

As with the system of FIG. 4, the system of FIG. 6 next performs a spin cycle whereby the liquid remaining in the garments within chamber 432 is removed. This liquid is drained from chamber 432, filtered by filter 470 and returned to storage tank 418 by operation of compressor 414 and a gas recirculation/fluffing cycle is performed, all in the manner described for the system of FIG. 4.

The pressure within chamber 432 must be reduced to atmospheric before the cleaned garments may be removed therefrom. As described with respect to the system of FIG. 4, this is accomplished by connecting the head space of chamber 432 to the suction side of compressor 414 via lines 494, 484 and 486. The discharge side of the compressor is placed in communication with the head space of external still 438 by lines 488, 492 and 498. Compressor 414 withdraws gas from chamber 432 and delivers it to external still 438 until the latter is pressurized to approximately 800 psi.

Once the external still 438 is pressurized to the appropriate level, the head space of internal still 320 is placed in communication with chamber 432 via line 478. In addition, the carbon dioxide gas from compressor 414 is redirected to the liquid side of storage tank 418 via lines 492, 502 and 496. As result, the carbon dioxide gas enters the liquid in storage tank 418 until the pressure in the tank increases to approximately 650 to 690 psi. At this point, the chamber 432 has been depressurized to approximately 50 to 60 psi. As described for the system of FIG. 4, this remaining pressure in the chamber may be safely vented to the atmosphere so that the chamber may be opened and the garments removed therefrom.

Due to the connection between chamber 432 and internal still 320, as compressor 414 removes carbon dioxide gas from chamber 432, the pressure within still 320 is also reduced. Furthermore, when compressor 414 directs carbon dioxide gas removed from chamber 432 to the liquid side of tank 418, the liquid in the tank surrounding the internal still is warmed. Both occurrences cause the liquid carbon dioxide within internal still 320 to boil. As the liquid carbon dioxide in still 320 vaporizes, soil and dye residue is left behind inside the still shell. The carbon dioxide vapor is removed from internal still 320, travels through chamber 432 and ultimately arrives at storage tank 418 where it is condensed into the liquid carbon dioxide contained therein. Similar to external still 438, the residue may be removed from the bottom of internal still 320 by periodically opening valve 504 so that the residue is blasted out of line 506 due to the pressure remaining in still 320.

As illustrated in FIG. 6, the internal still 320 is surrounded by a cylindrical shroud 508. Preferably, as illustrated in FIG. 6, the shroud covers approximately the bottom half of internal still 320 and extends somewhat beneath it. Shroud 508 is preferably constructed of metal and is open at the top and bottom. The shroud improves the efficiency of the distillation process performed by internal still 320. More specifically, the warmer carbon dioxide gas from the chamber 432 and compressor 414 is directed by line portion 510 into the annular space defined between the exterior surface of the sidewall of internal still 320 and shroud 508 as it enters tank 418. This provides two benefits. First, the warmer carbon dioxide gas is concentrated around the internal still so that the still sidewall is more efficiently heated. Second, the shroud 508 generally separates the warm carbon dioxide gas, and the liquid warmed thereby, from the remaining liquid carbon dioxide in tank 418 until heat is removed therefrom by still 320. As a result, the remaining liquid carbon dioxide in tank 418 remains cooler.

The systems of FIGS. 4–6, like the system of FIGS. 1A through 1M, feature a number of control valves. The operation of these valves may also be automated by the use of a microcomputer, process controller or similar device.

It is to be understood that the pressures and temperatures presented above are for example purposes only and that they are in no way intended to limit the scope of the invention. Furthermore, while the preferred embodiments of the invention have been shown and described, it will be apparent to those skilled in the art that changes and modifications may be made therein without departing from the spirit of the invention, the scope of which is defined by the appended claims.

What is claimed is:

1. A system for cleaning objects with liquid solvent comprising:

a) a cleaning chamber containing the objects;

b) a storage tank containing a supply of the liquid solvent with a head space there above and having a liquid side that is selectively in communication with said cleaning chamber; and c) a compressor selectively in circuit between said cleaning chamber and the head space of said storage tank, said compressor pressurizing said storage tank with gas from said cleaning chamber so that solvent is delivered from the liquid side of said storage tank to said cleaning chamber.

2. The system of claim 1 further comprising a means for agitating the objects in the cleaning chamber.

3. The system of claim 2 wherein the means for agitating the objects includes a basket rotatably mounted within said cleaning chamber and containing the objects.

4. The system of claim 1 wherein the means for agitating includes nozzles in circuit between the liquid side of the storage tank and the cleaning chamber.

5. The system of claim 1:

further comprising a still containing contaminated liquid solvent with a head space there above; and wherein said compressor is selectively in circuit between the head space of said still and said cleaning chamber, said compressor pressurizing said cleaning chamber with gas from said still so that the contaminated liquid solvent in said still is vaporized and solvent vapor produced thereby is transferred to said cleaning chamber.

6. The system of claim 1 further comprising a still containing contaminated liquid solvent with a head space there above, the head space of said still selectively communicating with and pressurizing said cleaning chamber with gas from said still so that the contaminated liquid solvent in said still is vaporized and solvent vapor produced thereby is transferred to said cleaning chamber.

7. The system of claim 6 further comprising means for heating said still.

8. The system of claim 1:

further comprising a still; and wherein said cleaning chamber contains liquid solvent with a head space there above and includes a liquid side that is selectively in communication with said still and said compressor is selectively in circuit between said still and the head space of said cleaning chamber, said compressor pressurizing said cleaning chamber with gas from the still so that liquid solvent flows from the liquid side of said cleaning chamber to said still.

9. The system of claim 1 further comprising a transfer tank containing an additional supply of liquid solvent, said transfer tank selectively communicating with said cleaning chamber so that additional solvent may be added to the system.

10. The system of claim 1:

wherein said cleaning chamber contains liquid solvent with a head space there above and includes a liquid side; and further comprising a filter selectively in circuit between the liquid side of said cleaning chamber and said storage tank and said compressor selectively in circuit between said storage tank and the head space of said cleaning chamber, said compressor pressurizing said cleaning chamber with gas from said storage tank so that solvent is delivered from the liquid side of the cleaning chamber through the filter to the storage tank.

11. The system of claim 10:

wherein said filter includes an outlet side; and further comprising a dispenser containing a supply of an additive, said dispenser in communication with the outlet side of said filter so that the additive is injected into filtered liquid solvent exiting the outlet side of the filter.

12. The system of claim 10:

wherein said filter includes an inlet side; and further comprising a still and means for selectively placing the still in communication with the inlet side of the filter so that liquid solvent from the cleaning chamber may be selectively directed to the still without filtration.

13. The system of claim 10 further comprising a pressure relief valve positioned in circuit between the filter and the storage tank, said pressure relief valve opening to permit solvent to flow to the storage if pressure within the filter exceeds a predetermined value.

14. The system of claim 1 further comprising a pressure relief valve positioned in circuit between the cleaning chamber and the storage tank, said pressure relief valve opening to permit solvent to flow to the storage if pressure within the cleaning chamber exceeds a predetermined value.

15. The system of claim 1 further comprising:

d) a still positioned within said storage tank, said still selectively communicating with said cleaning chamber so as to receive liquid solvent therefrom; and e) means for depressurizing said still so that liquid solvent therein boils.

16. The system of claim 15:

further comprising a cylindrical shroud partially surrounding said still so that an annular space is defined between the still and the shroud; and wherein said compressor is selectively in circuit between the cleaning chamber and a bottom of said shroud so that gas from the cleaning chamber is directed into the annular space so that the still is warmed to improve boiling of the liquid solvent therein.

17. A system for filtering liquid solvent contained in a cleaning chamber with a head space there above and where the cleaning chamber includes a liquid side comprising:

a) an eductor having a gas inlet, a liquid inlet and an outlet;

b) a filter having an inlet side and an outlet side; and c) a compressor selectively in circuit between the head space of said cleaning chamber and the gas inlet of said eductor so that solvent gas is withdrawn from said cleaning chamber and directed to said eductor;

d) the liquid side of said cleaning chamber in communication with a liquid inlet of said eductor so that liquid solvent from the cleaning chamber is transferred to said eductor and combined with the solvent gas from the cleaning chamber so that a stream of solvent fluid exits the outlet of the eductor; and e) the outlet of said eductor in communication with the inlet side of said filter and the outlet side of said filter in communication with the cleaning chamber so that the stream of solvent fluid from the outlet of the eductor passes through the filter and then to the cleaning chamber.

18. A system for warming liquid solvent contained in a cleaning chamber comprising:

a) a storage tank containing an additional supply of liquid solvent with a head space there above; and b) a compressor selectively in circuit between the head space of the storage tank and the cleaning chamber, said compressor withdrawing gas from the storage tank and directing it to the cleaning chamber so that the liquid solvent in the storage tank boils and warm vapor produced thereby is transferred to the cleaning chamber so that the liquid solvent therein is warmed.

19. A system for warming liquid solvent contained in a cleaning chamber with a head space there above and where the cleaning chamber includes a liquid side comprising:

a) a compressor including a suction side in communication with the head space of the cleaning chamber and a discharge side in communication with the liquid side of the cleaning chamber so that solvent gas is with withdrawn from the head space of the cleaning chamber and provided to the liquid side of the cleaning chamber;

b) a flow restrictor selectively in circuit between the head space of the cleaning chamber and the suction side of the compressor, said flow restrictor causing solvent gas passing through the compressor to be heated so that warmed solvent gas is provided to the liquid side of the cleaning chamber.

20. The system of claim 19 further comprising a heat exchanger in circuit between the flow restrictor and the suction side of the compressor so that solvent gas traveling to the compressor is warmed.

21. The system of claim 19 wherein said flow restrictor is an orifice.

* * * * *